US006508539B2

(12) United States Patent
Tanaka

(10) Patent No.: US 6,508,539 B2
(45) Date of Patent: Jan. 21, 2003

(54) LIQUID-FIRING HEAD AND MANUFACTURING METHOD THEREOF, INK-JET RECORDING DEVICE AND MICRO-ACTUATOR

(75) Inventor: Makoto Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 7 days.

(21) Appl. No.: 09/875,394

(22) Filed: Jun. 6, 2001

(65) Prior Publication Data

US 2001/0055046 A1 Dec. 27, 2001

(30) Foreign Application Priority Data

Jun. 21, 2000 (JP) ..... 2000-185712

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

FOREIGN PATENT DOCUMENTS

| | | |
|---|---|---|
| JP | 6071882 | 3/1994 |
| JP | 9039235 | 2/1997 |
| JP | 9193375 | 7/1997 |

OTHER PUBLICATIONS

Application S.N. 09/550,408, filed Apr. 14, 2000.
Application S.N. 09/401,043, filed Sep. 22, 1999.
Application S.N. 09/632,047, filed Aug. 3, 2000.
Application S.N. 09/632,046 filed Aug. 3, 2000.
Application S.N. 09/346,056 filed Jun. 29, 1999.

*Primary Examiner*—Raquel Yvette Gordon
(74) *Attorney, Agent, or Firm*—Cooper & Dunham LLP

(57) ABSTRACT

A liquid-firing head includes a nozzle firing a liquid drop; a liquid chamber communicating with the nozzle; a vibration plate which acts as a wall of the liquid chamber; and an electrode facing the vibration plate. The vibration plate is deformed by an electrostatic force, and, thereby, the liquid drop is fired through the nozzle. A groove for forming a gap between the electrode and the vibration plate is formed in the electrode.

124 Claims, 26 Drawing Sheets

LIQUID-FIRING HEAD AND MANUFACTURING METHOD THEREOF, INK-JET RECORDING DEVICE AND MICRO-ACTUATOR

BACKGROUND OF THE INVENTION

1. Field of the Invention

The present invention generally relates to a liquid-firing head and a manufacturing method thereof, and, an ink-jet recording device and a micro-actuator.

2. Description of the Related Art

In general, an electrostatic ink-jet head, which is one of liquid-firing heads, is used in an ink-jet recording device used as an image recording/forming device of a printer, a facsimile machine, a copier, a plotter and so forth. The electrostatic ink-jet head includes a nozzle firing an ink drop, a liquid chamber (which may also be referred to as an ink flow path, a pressurizing chamber, a firing chamber, a pressure chamber, a pressurizing liquid chamber, or the like) communicating with the nozzle, a vibration plate which is used as a wall of the liquid chamber, and an electrode facing the vibration plate. Then, as a result of a voltage being applied between the vibration plate and electrode, an electrostatic force is generated, which deforms the vibration plate so that the pressure/volume in the liquid chamber is changed. As a result, an ink drop is fired via the nozzle. A part of this ink-jet head including the vibration plate and electrode is called a micro-actuator. The micro-actuator may also be used as a micro-pump or the like.

Japanese Laid-Open Patent Application No. 6-71882discloses such an electrostatic ink-jet head. In this ink-jet head, the vibration plate which is used as a wall of the liquid chamber and the electrode are disposed in parallel with one another. A gap formed thereby is called 'a parallel gap'.

Further, Japanese Laid-Open Patent Application No. 9-39235 discloses an electrostatic ink-jet head in which a length of a gap formed between the vibration plate and electrode varies stepwise as a result of the electrode being disposed stepwise. Furthermore, Japanese Laid-Open Patent Application No. 9-193375 discloses such an electrostatic ink-jet head that, as a result of the electrode being disposed obliquely with respect to the vibration plate, a sectional shape of the gap formed between the vibration plate and electrode is such that a surface on the vibration plate and a surface on the electrode are not parallel at least at a part thereof (such a gap is called 'non-parallel gap').

In such an electrostatic ink-jet head (also in a micro-actuator), it is necessary to form the gap between the vibration plate and electrode at a high accuracy. For this purpose, an oxide film is formed on a silicon substrate, or an insulating substrate such as a Pyrex glass is used, a groove for forming an electrode having a predetermined depth is formed into the oxide film or insulating substrate, and an electrode having a predetermined thickness is formed on a bottom surface of the groove. Thereby, as a result of utilizing the part of the oxide film or insulating substrate other than the groove as a gap spacer for determining the gap between the vibration plate and electrode, it is possible to obtain a predetermined gap length between the vibration plate and electrode.

However, in such an electrostatic ink-jet head in the related art, when the above-mentioned parallel gap is formed, the gap length (the distance between the surface of the vibration plate and the surface of the electrode) may vary, due to variation in depth of the groove for forming the electrode (variation in height of the gap spacer), variation in thickness of the electrode, and also, variation in thickness of a protection insulating film if this film is formed on the surface of the electrode. Also, it is difficult to further reduce the size of the gap.

Further, if the non-parallel gap is formed, especially if the non-parallel gap starting from a position at which the gap length of 0 is formed, a groove having a shape of the non-parallel gap should be formed in a silicon substrate, and an electrode should be formed in the groove. Accordingly, an end of the electrode or an end of a protection insulating film formed on the surface of the electrode may project from or may be lower than the top surface of the silicon substrate (the top surface of the gap spacer). Thereby, unevenness occurs on the surface of the silicon substrate.

In such a case, it may be difficult to bond the thus-formed part with a substrate in which a vibration plate is provided, or, even when the bonding may be achieved, such a large amount of polishing is needed for enabling the bonding that variation in gap length increases.

When variation in gap length thus increases, it may result in variation in firing performance of the resulting ink-jet head such as ink-drop firing volume, ink-drop firing speed and so forth, variation in position at which fired ink reaches, degradation in image quality obtained through printing by using the ink-jet head, and so forth.

SUMMARY OF THE INVENTION

The present invention has been devised in consideration of the above-mentioned problems, and, an object of the present invention is to provide a liquid-firing head in which gap accuracy is improved, a method of manufacturing it, an ink-jet recording device in which image quality of recorded image is improved, and a micro-actuator in which the gap accuracy is improved.

A liquid-firing head according to the present invention comprises:

a nozzle firing a liquid drop;

a liquid chamber communicating with the nozzle;

a vibration plate which acts as a wall of the liquid chamber; and an electrode facing the vibration plate, and wherein the vibration plate is deformed by an electrostatic force, and, thereby, the liquid drop is fired through the nozzle, and wherein a groove for forming a gap between the electrode and the vibration plate is formed in the electrode.

Thereby, it is possible to form the gap at a high accuracy, and to improve the ink-drop firing performance.

In this configuration, it is preferable that the electrode comprises a polysilicon layer. Thereby, it is possible to easily form the high-accuracy gap.

A liquid-firing head according to another aspect of the present invention comprises:

a nozzle firing a liquid drop;

a liquid chamber communicating with the nozzle;

a vibration plate which acts as a wall of the liquid chamber; and an electrode facing the vibration plate, and wherein the vibration plate is deformed by an electrostatic force, and, thereby, the liquid drop is fired through the nozzle, and wherein a groove for forming a gap between a protection insulating film, formed on the electrode, and the vibration plate is formed in the protection insulating film.

Thereby, controllability of the gap is improved, and the process yield increases.

In this configuration, the electrode may comprise one of a polysilicon layer, a tungsten silicide layer, a titan silicide layer, and a laminated layer thereof. Thereby, it is possible to easily form the protection insulating film.

Further, the protection insulating film may comprise one of a polysilicon oxide film or a high-temperature oxide film. Thereby, the reliability is improved, and degradation of the electric performance is reduced.

A liquid-firing head according to another aspect of the present invention comprises:

a nozzle firing a liquid drop;

a liquid chamber communicating with the nozzle;

a vibration plate which acts as a wall of the liquid chamber; and an electrode facing the vibration plate, and wherein the vibration plate is deformed by an electrostatic force, and, thereby, the liquid drop is fired through the nozzle, and wherein:

a gap spacer part determining a gap between the vibration plate and the electrode comprises the same layer as that of the electrode; and a groove for forming the gap between the electrode and the vibration plate is formed in the electrode.

Thereby, the gap accuracy is improved, the liquid-firing performance is improved, a high-accuracy gap can be formed with higher process yield, and, in particular, a high-accuracy non-parallel gap can be easily formed.

In this configuration, by employing a polysilicon layer for the electrode, it is possible to easily form the high-accuracy gap.

A liquid-firing head according to another aspect of the present invention comprises:

a nozzle firing a liquid drop;

a liquid chamber communicating with the nozzle;

a vibration plate which acts as a wall of the liquid chamber; and an electrode facing the vibration plate, and wherein the vibration plate is deformed by an electrostatic force, and, thereby, the liquid drop is fired through the nozzle, and wherein:

a groove for forming a gap between the electrode and the vibration plate is formed in the electrode; and a part of the electrode is used as a gap spacer part determining the gap between the electrode and the vibration plate.

Thereby, it is possible to form a higher-accuracy gap, and the liquid-drop firing performance is improved.

In this configuration, by employing a polysilicon layer for the electrode, it is possible to easily form the high-accuracy gap.

In any of the above-mentioned configurations, the gap formed by the groove of the electrode may have an inclined surface providing a part at which a gap length is zero.

Thereby, it is possible to improve an effect of reducing the driving voltage and the liquid-drop firing performance.

A liquid-firing head according to another aspect of the present invention comprises:

a nozzle firing a liquid drop;

a liquid chamber communicating with the nozzle;

a vibration plate which acts as a wall of the liquid chamber; and an electrode facing the vibration plate, and wherein the vibration plate is deformed by an electrostatic force, and, thereby, the liquid drop is fired through the nozzle, and wherein:

the electrode has a protection insulating film on a surface thereof;

a gap spacer part determining a gap between the vibration plate and the electrode is formed of the laminated film same as the electrode and the protection insulating film; and a groove for forming the gap between the vibration plate and the protection insulating film is formed in the protection insulating film.

Thereby, the gap accuracy is improved, the liquid-firing performance is improved, a high-accuracy gap can be formed with higher process yield, and, in particular, a high-accuracy non-parallel gap can be easily formed.

A liquid-firing head according to another aspect of the present invention comprises:

a nozzle firing a liquid drop;

a liquid chamber communicating with the nozzle;

a vibration plate which acts as a wall of the liquid chamber; and an electrode facing the vibration plate, and wherein the vibration plate is deformed by an electrostatic force, and, thereby, the liquid drop is fired through the nozzle, and wherein:

the electrode has a protection insulating film on a surface thereof;

a groove for forming the gap between the vibration plate and the protection insulating film is formed in the protection insulating film; and a part of the electrode and the protection insulating film is used as a gap spacer part determining the gap between the vibration plate and the protection insulating film.

Thereby, the gap accuracy is improved, the liquid-firing performance is improved, a high-accuracy gap can be formed with higher process yield, and, in particular, a high-accuracy non-parallel gap can be easily formed.

In any of the above-mentioned configurations, the electrode may comprise one of a polysilicon layer, a tungsten silicide layer, a titan silicide layer, and a laminated layer thereof. Thereby, it is possible to easily form the protection insulating film. Further, the protection insulating film may comprise one of a polysilicon oxide film or a high-temperature oxide film. Thereby, the reliability is improved, and degradation in the electric performance is reduced. Furthermore, the protection insulating film may also be formed on a side surface of the electrode. Thereby, the reliability of the device is improved.

Further, the protection insulating film may fill each separating region formed between the particular electrodes. Thereby, a polishing process or a process of forming a gradation pattern can be performed after dividing the electrode into the particular ones. Accordingly, flexibility in process is improved. Further, the gap formed by the groove of the protection insulating film may have an inclined surface providing a part at which a gap length is zero. Thereby, an effect of reducing the driving voltage and the liquid-drop firing performance can be improved. Furthermore, the groove may be formed after the electrode is divided into particular electrodes, the protection insulating film fills a separating region between the particular electrodes, and the surface of the protection insulating film is polished. Thereby, the gap accuracy is improved.

Further, in any of the above-mentioned configurations, the surface of the gap spacer part may be mirror-polished so as to have a surface morphology not larger than 1 nm. Thereby, it is possible to render silicon direct bonding with high reliability in the bonding. Furthermore, the periphery of the gap may be sealed. Thereby, it is possible to easily prevent water or the like from entering the gap when the wafer is divided into particular chips. In this case, a measure enabling the inner pressure of the gap to be opened to the atmospheric pressure during manufacture thereof may be provided. Thereby, it is possible to reduce variable variations in resulting performance, and to improve the firing efficiency. In this case, a communicating path enabling the gap to communicate with the atmosphere may be provided in a region other than an electrode drawing part for externally drawing the electrode. Thereby, it is possible to easily open the gap to the atmosphere while preventing water or the like from entering the gap A method of manufacturing a liquid-firing head according to the present invention having the groove formed in the electrode, comprising the steps of:

a) polishing the surface of the electrode; and b) forming the groove after the step a).

Thereby, variation in gap (size/shape) is reduced, and, a high-accuracy gap with little variation, that is, uniform, can be formed.

A method of manufacturing another liquid-firing head according to the present invention having the groove formed in the protection insulating film, comprising the steps of:

a) polishing the surface of the protection insulating film; and b) forming the groove after the step a).

Thereby, variation in gap is reduced, and, a high-accuracy gap with little variation can be formed.

Another method of manufacturing a liquid-firing head according to the present invention having the groove formed in the electrode, comprising the steps of:

a) forming the grooves in the electrode; and b) dividing the electrode to particular electrodes after the step a).

Thereby, variation in gap is reduced, and, a high-accuracy gap with little variation can be formed.

Another method of manufacturing a liquid-firing head according to the present invention having the groove formed in the protection insulating film, comprising the steps of:

a) forming the grooves in the protection insulating film; and b) dividing the electrode and the protection insulating film to particular electrodes and protection insulating films after the step a).

Thereby, a non-parallel gap can be formed at a high accuracy.

Another method of manufacturing a liquid-firing head according to the present invention comprising the steps of:

a) dividing the electrode into particular electrodes;

b) filing a separating region between the particular electrodes with the protection insulating film;

c) polishing the surface of the protection insulating film; and d) forming the groove after the steps a), b) and c).

Thereby, a high-accuracy gap can be formed in a process having improved flexibility.

A method of manufacturing a liquid-firing head according to the present invention in which the periphery of the gap is sealed, comprising the step of opening the inner pressure of the gap to the atmospheric pressure during manufacture thereof. Thereby, it is possible to reduce various problematic variations in resulting performance. In this case, the step of opening the inner pressure of the gap to the atmospheric pressure during manufacture thereof through a communicating path provided in a region other than an electrode drawing part for externally drawing the electrode may be included. Thereby, it is possible to easily open the gap to the atmosphere while preventing water or the like from entering the gap.

An ink-jet recording device according to the present invention comprising an ink-jet head for firing an ink drop, wherein the ink-jet head comprises a liquid-firing head according to the present invention described above, or is manufactured by a method according to the present invention described above. Thereby, the ink-drop firing performance, and ink-drop reaching position accuracy are improved, and, thereby, the image quality of an image printed by the recording device is improved.

A micro-actuator according to the present w invention, comprises:

a vibration plate; and an electrode facing the vibration plate, wherein the vibration plate is displaced by an electrostatic force, and wherein one of the electrode and a protection insulating film formed on the electrode has a gap between the vibration plate and the electrode.

Thereby, it is possible to form a high-accuracy gap, and, thereby, improve the operation performance of the actuator.

A micro-actuator according to another aspect of the present invention, comprises:

a vibration plate; and an electrode facing the vibration plate, wherein the vibration plate is displaced by an electrostatic force, and wherein a gap spacer part determining a gap between the vibration and the electrode comprises the same layer as one of the electrode and the electrode with a protection insulating film.

Thereby, it is possible to form a high-accuracy gap, and, thereby, improve the operation performance of the actuator. Furthermore, a high-accuracy gap can be formed with high process yield, and, in particular, a high-accuracy non-parallel gap can be easily formed.

Other objects and further features of the present invention will become more apparent from the following detailed description when read in conjunction with the accompanying drawings.

DETAILED DESCRIPTION OF THE PREFERRED EMBODIMENTS

Figure 1:
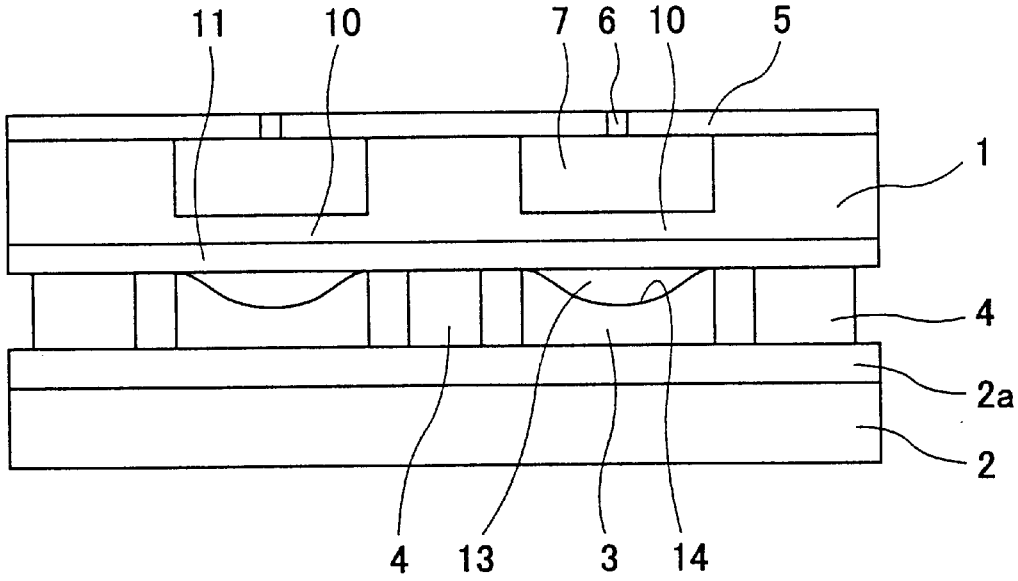
FIG. 1 shows a typical sectional view of an ink-jet head in a first embodiment of the present invention taken along a vibration-plate lateral direction.
Figure 2:
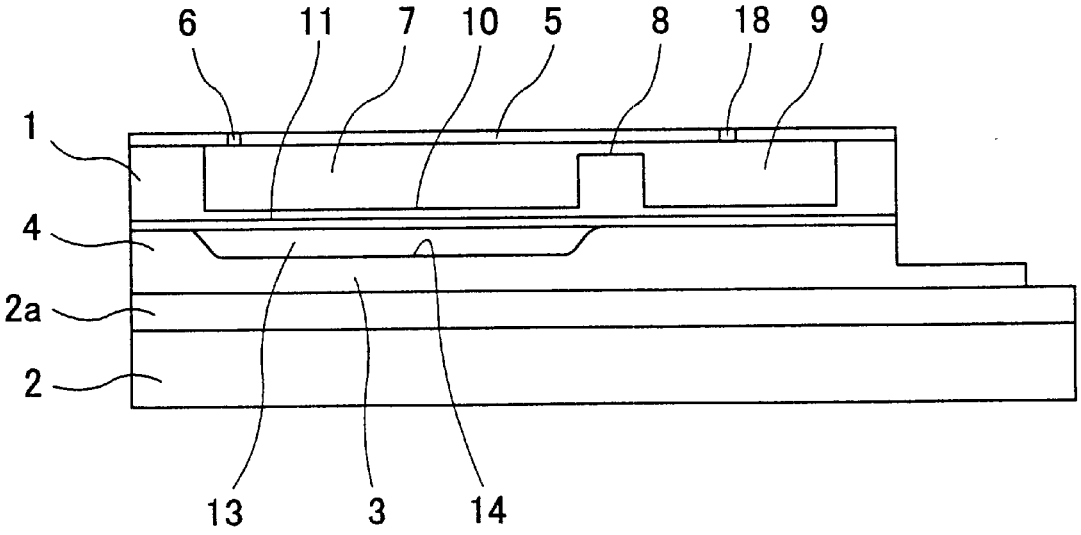
FIG. 2 shows a typical sectional view of the same ink-jet head taken along a vibration-plate longitudinal direction.

A first embodiment of the present invention will now be described with reference to FIGS. 1 and 2. FIG. 1 shows a typical magnified sectional view of an ink-jet head in the first embodiment of the present invention taken along a direction of a short side of a vibration plate; and FIG. 2 shows a typical magnified sectional view of the same ink-jet head in the first embodiment of the present invention taken along a direction of a long side of the vibration plate.

This ink-jet head includes a vibration-plate substrate 1, a base substrate 2 disposed under the vibration-plate substrate 1 and having an electrode 3 and a gap spacer 4, and a nozzle plate 5 bonded onto the top surface of the vibration-plate substrate 1. Further, the ink-jet head includes a nozzle 6 through which an ink drop which is a liquid drop is fired, a liquid chamber 7 communicating with the nozzle 6, and a common liquid chamber 9 from which the ink is supplied to the chamber 7 via a fluid resistance part 8.

The vibration-plate substrate 1 includes a recess including the liquid chamber 7 and a vibration plate 10 used as a bottom plate of the liquid chamber 7 are formed, a recess including a groove forming the fluid resistance part 8 and the common liquid chamber 9, and a thermal oxide film 11 on the surface of the vibration plate 8 facing the electrode 3. This vibration-plate substrate 1 may be formed by using an SOI substrate including silicon substrates bonded together via an oxide film, for example. In this case, it is possible to form the vibration plate 10 at a high accuracy as a result of forming the recess of the liquid chamber 7 through etching with an enchant of KOH solution or the like with utilizing the oxide film layer as an etching stop layer. Furthermore, it is also possible to form the vibration plate 10 at a high accuracy as a result of forming a high-concentration P-type impurity diffused layer, for example, a boron diffused layer on the silicon substrate, and performing etching with utilizing the boron diffused layer as an etching stop layer.

The base substrate 2 includes a thermal oxide film 2*a* formed by a thermal oxidation method or the like on a silicon substrate, and the electrode 3 and gap spacer 4 provided on the oxide film 2*a*. These electrode 3 and gap spacer 4 are formed of polysilicon layers, respectively, and, also, a part of the electrode 3 in the direction of the long side of the vibration plate is also used as the spacer 4, as shown in FIG. 2. This electrode 3 includes a groove 14 forming a gap 13 having a predetermined sectional shape between the electrode 3 and vibration plate 10. The electrode 3 and vibration plate 10 form a micro-actuator which deforms the vibration plate 10 through an electrostatic force.

Figure 3:
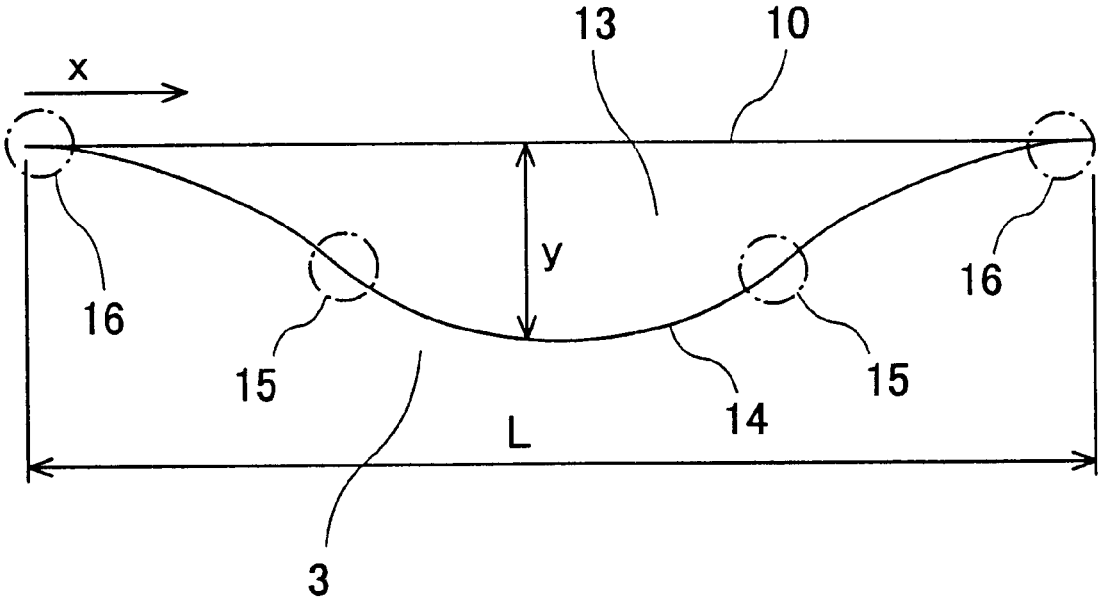
FIG. 3 illustrates a gap shape of the same head.

As it is also be typically shown in FIG. 3, the gap 13 has an inflection point 15 in a sectional shape taken along a direction of a short side thereof, and, also, has contact portions 16 (at which the gap length becomes '0' substantially) at which the bottom surface of the gap 13 comes into contact with the vibration plate 10 (oxide film 11) in a tangent manner at both ends in the directions of the short side thereof. That is, the gap 13 has inclined surfaces providing points at which the gap length is 0.

In this case, as shown in FIG. 3, the groove 14 satisfies the requirement expressed by the following formula (1) throughout the gap 13:

$$y=A(x^4-2Lx^3+L^2x^2) \quad (1)$$

where x denotes a position along a side (in this case, the short side) of the electrode 3, y denotes a gap (effective gap) between the vibration plate 10 and electrode 3 at the position x, A and L denote constants.

The shape expressed by the above formula (1) is called a Gaussian shape. It is especially preferable that the gap 13 has a sectional shape having a Gaussian shape on the surface of the electrode 3. However, it is also possible that the gap 13 has a sectional shape near a Gaussian shape as a result of the sectional shape having inflection points 15. Further, it is not necessary that the gap 13 satisfies the requirement of the above formula (1) throughout the gap 13, and it is possible to obtain a similar effect as a result of the gap 13 satisfying the above formula (1) only at a part of the gap 13.

The nozzle plate 5 is made of a metal layer, a laminated member including a metal layer and a high-polymer layer bonded together, a resin member, a nickel electro-plated member or the like, and includes the nozzles 6 formed therein. A nozzle surface (surface in a direction in which ink is fired; firing surface) of the nozzle plate 5 has a plated film or a liquid repellent film formed by a well-known method such as liquid-repellent-agent coating, formed thereon, for the purpose of providing ink repellency of the surface. Further, ink-supply holes 18 are also formed in the nozzle plate 5 through which the ink is externally supplied to the common liquid chamber 9.

The vibration-plate substrate 1 and base substrate 2 (more specifically, gap spacer 4) are bonded together by silicon direct-bonding (DB).

Operation of this ink-jet head will now be descried. The vibration plate 10 is used as a common electrode while the electrode 3 is used as a particular electrode, and a driving voltage is applied between the vibration plate 10 and electrode 3. Thereby, by an electrostatic force generated between the vibration plate 10 and electrode 31 the vibration plate 10 is deformed toward the electrode 3. Then, in this condition, the charge between the vibration plate 10 and electrode 3 is discharged. Thereby, the vibration plate 10 returns to the original shape (cancels the deformation). Thus, the inner volume/pressure of the liquid chamber 7 is changed, so that an ink drop is fired through the nozzle 6 therefrom.

In more detail, when a pulse voltage is applied to the electrode 3, a potential difference is generated between the electrode 3 and vibration plate 10, and, thereby, an electrostatic force is generated therebetween. As a result, the vibration plate 10 is deformed by an amount according to the magnitude of the voltage applied. Then, the voltage applied is decayed so that the deformation of the vibration plate 10 is cancelled. By this restoration force, the pressure inside of the liquid chamber 7 increases, and, thereby, an ink drop is fired therefrom through the nozzle 6.

In this case, the electrostatic force applied to the vibration plate 10 becomes larger as the gap length between the vibration plate 10 and electrode 3 becomes smaller. Accordingly, the deformation of the vibration plate 10 starts from the point at which the gap length is 0 (the contact portions 16 shown in FIG. 3). Then, as the deformation increases, the gap length becomes smaller, and, thereby, the voltage needed for deforming the vibration plate 10 becomes lower. Thus, it is possible to effectively reduce the voltage needed for driving the ink-jet head by employing the above-described gap shape.

The gap 13 between the vibration plate 10 and electrode 3 is formed by the groove 14 formed in the electrode 3 itself. Accordingly, it is possible to easily form the non-parallel gap at a high accuracy.

It has been already seen that the non-parallel gap is very advantageous for reducing the voltage needed for driving the ink-jet head in comparison to the parallel gap. In this case, this effect depends on the angle of inclination of the bottom surface of the gap. When the inclination is gentle, the vibration plate 10 is deformed toward so as to comes into contact with the electrode 3 smoothly from the ends at which the gap length is 0. Accordingly, not only the voltage needed for the driving can be reduced, but also, variation in pressure in the liquid chamber 7 can be effectively reduced, so that meniscus vibration around the nozzle 6 can be reduced. As a result, in this case, variation in volume and speed of ink drop being fired is effectively reduced, controllability of the head is improved, and, also, accuracy in position at which the fired ink drop reaches is improved. Accordingly, the printing quality can be improved. In this case, it is assumed that the gap 13 has a shape of Gaussian distribution as mentioned above. This Gaussian shape is a shape matching a shape of the deformed vibration plate 10, and is most advantageous for reducing the voltage needed for driving the ink-jet head although it is not so advantageous for smooth contact in comparison to gentle inclination. This fact was proved through simulation and experiment.

A method of manufacturing the above-described ink-jet head in the first embodiment of the present invention will now be described with reference to FIGS. 4A through 4D and 5A through 5C.

Figure 4A:
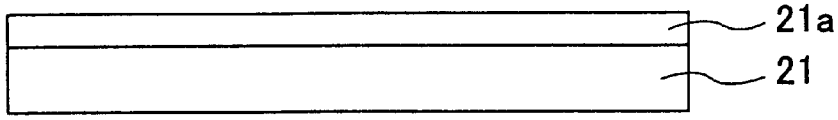
FIGS. 4A, 4B, 4C, 4D, 5A, 5B and 5C illustrate a manufacturing process of the same head.

First, as shown in FIG. 4A, a base oxide film 21*a* is formed on a silicon base body (silicon wafer is used) 21 for insulating between the base body 21 and the electrode 3 acting as a particular electrode. The base body 21 is used for supporting the particular electrode. In this case, the base oxide film 21*a* is a thermal oxide film and has a thickness on the order of 0.5 through 2.0 $\mu$m. However, the type of the oxide film employed is not limited thereto.

Figure 4B:
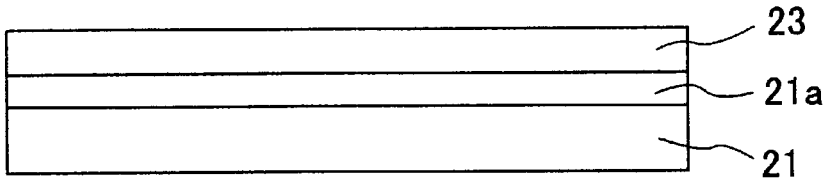

Then, as shown in FIG. 4B, a polysilicon film (polysilicon layer) 23 is formed on the oxide film 21*a* of the silicon base body 21. In this case, in this polysilicon film 23, phosphorous is ion-implanted and thermally diffused for the purpose of providing impurity for reducing the electric resistivity.

A method of providing impurity into the polysilicon film for the purpose of reducing resistivity is not limited to ion implantation and thermally diffusing, but any other well-known method may be used. However, employing a method by implantation is preferable such that micro-roughness on the surface of the polysilicon becomes minimum. So-called doped polysilicon in which impurity is provided during film formation also has a relatively smooth surface. However, the smoothness is degraded when the film thickness is increased according to the depth of the groove for the gap. Furthermore, in a method by deposition diffusion using a diffusion source, crystal of polysilicon grows remarkably so that surface roughness becomes larger.

Then, the surface of the polysilicon film 23 is mirror-polished. This process is performed so that morphology of the surface is improved, and, thereby, direct bonding between the silicon base body 21 and a silicon base body 31 described later to be the vibration-plate substrate is enabled. This process is performed for the purpose of improving the morphology of the surface, and polishing should be performed so that the micro-roughness of the polished surface becomes such that the resulting surface morphology is not more than the order of 1 nm. Practically, a polishing amount on the order of 0.005 through 0.2 $\mu$m results in a necessary polished surface.

The above-mentioned polishing amount should be determined appropriately depending on the morphology of the polysilicon, and is not limited to the above-mentioned range. The morphology of the polysilicon layer/film depends on a method of forming it (including a method of forming film, a method of providing impurity thereinto, a method of activating the impurity and so forth), a film thickness, and so forth, and setting of the polishing amount therefor appropriately is needed.

When the above-mentioned polishing process were not performed, a bonding strength of direct bonding would have been degraded remarkably, many voids would have been generated in the bonded surface, and, in an extreme case, the bonding could not have been rendered at all. In formation of an SOI substrate used for producing semiconductor LSI or the like, normally, morphology not more than the order of 0.3 nm is needed, in general. In a case of the present invention, it is necessary that bonding strength is needed such that the bonded member will not be removed during the subsequent processes. Accordingly, according to experiment, such bonding can be rendered when the surface morphology is in a range not exceeding 1 nm.

Figure 4C:
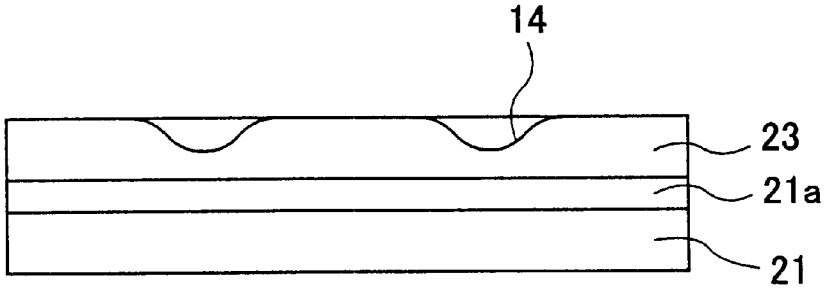

Then, as shown in FIG. 4C, in the surface of the polysilicon film 23, grooves 14 becoming the gaps (electrostatic gaps) 13 are formed. These grooves 14 have configurations such that each of the gaps 13 has a sectional shape of non-parallel gap in which at least one side portion thereof has an inclined outline smooth without any vertical steps (in this case, a non-parallel gap in which at least one side portion thereof starts from the gap length of 0). Specifically, each groove 14 has a configuration such that a gap 13 resulting therefrom has a Gaussian distribution shape as described above.

Such a shape of each groove 14 can be rendered by the following processes: First, a mask having a gradation pattern according to a necessary groove depth is produced; a resist pattern corresponding to the necessary groove depth is formed by using the thus-produced mask; and the thus-formed resist pattern is transferred to the polysilicon film 23 by dry-etching method. In this case, setting is made such that the etching rate for the resist is normally higher than the etching rate for the polysilicon. However, as the transfer is not necessarily rendered simply in proportion to the ratio of the etching rates, appropriate setting of resist shape and etching requirement should be made each time according to a particular desired shape.

Figure 4D:
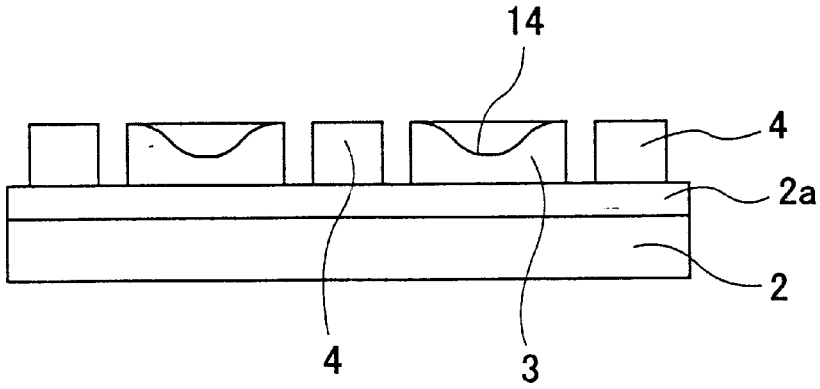

Then, as shown in FIG. 4D, resist is coated or laminated on the polysilicon film 23, a mask pattern having necessary openings is formed by photoengraving method, etching of the polysilicon film 23 is performed, the polysilicon film 23 is separated/split into the particular electrodes 3 and gap spacers 4, and, thus, the base substrate 2 on which the electrodes 3 and gap spacers 4 are provided via the oxide film 2*a* is obtained. The oxide film 2*a* is made of the base oxide film 21*a,* and the base substrate 2 is made of the silicon base body 21.

Thus, by forming the gap spacer and electrode 3 by the same material (in this case, the same layer), direct bonding thereof is enabled as a result of slight surface polishing being performed thereon. Further, the gap shape and depth can be controlled well and the gap 14 can be formed uniformly. Thereby, it is possible to form the groove for the non-parallel gap which enables smooth contact and includes a zero gap portion.

Figure 5A:
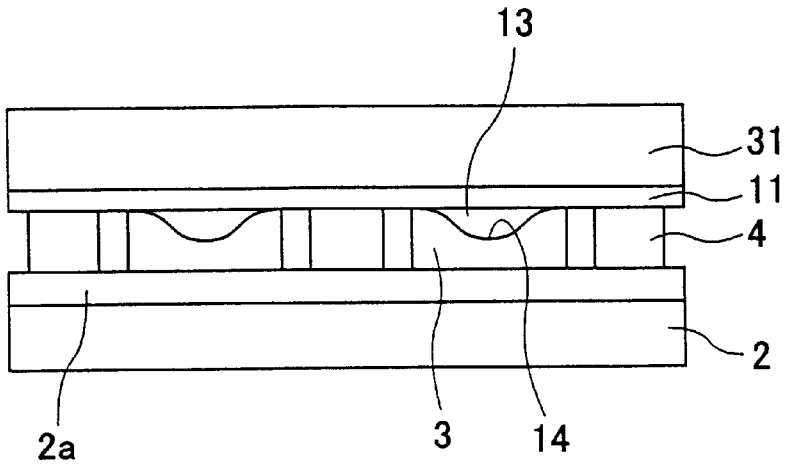

Then, as shown in FIG. 5A, a silicon base body 31 forming the vibration-plate substrate 1 is bonded onto the base substrate 2 (more specifically, the gap spacers 4) having the particular electrodes 3, by direct bonding. In this case, because no insulating film is formed on the electrodes 3 made from the polysilicon film 23, a thermal oxide film 11 is previously formed on the silicon base body 31 onto which the bonding is made, before the bonding, in order to electrically insulate the vibration plate 10 from the electrode 3. In such a case of bonding of silicon base bodies together (silicon direct bonding), it is preferable that at least one thereof has an oxide film formed thereon so that the bonding can be rendered easily.

Figure 5B:
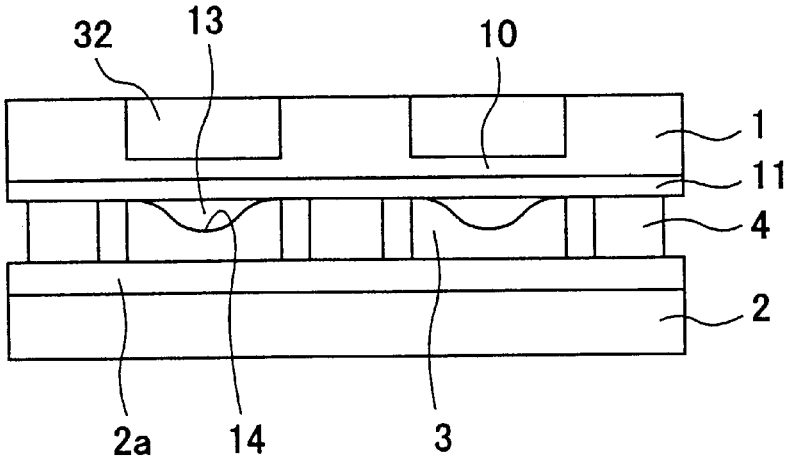

Then, as shown in FIG. 5B, recesses 32 are formed into the silicon base body 31 for a flow-path pattern for the liquid chambers 7 and so forth, the liquid chambers 7, vibration plate 10 and so forth are formed, and, thus, the vibration-plate substrate 1 is obtained. In this case, a silicon substrate having a crystal plane orientation (110) is used as the silicon base body 31, and, anisotropic etching is performed with KOH solution on the order of 10 wt % through 30 wt %. A mask used in the anisotropic etching is formed as a result of patterning a nitride film formed by reduced pressure CVD or plasma CVD, or a laminated film made of an oxide film and the above-mentioned nitride film.

Figure 5C:
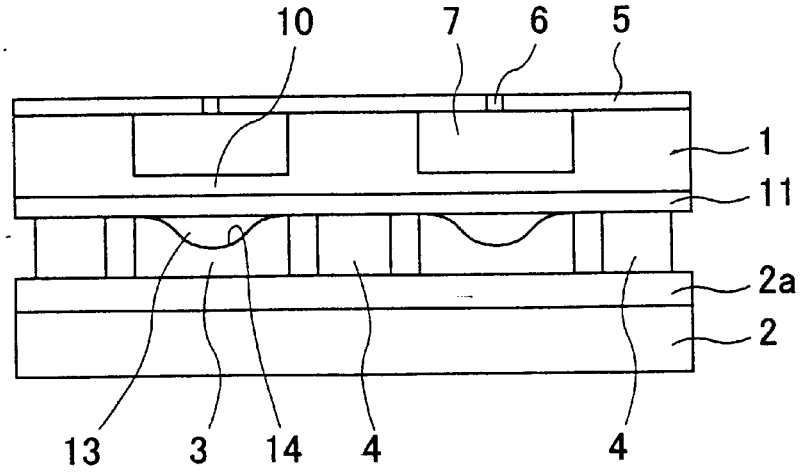

Then, as shown in FIG. 5C, the nozzle plate 5 is bonded onto the vibration-plate substrate 1, and, thus, the ink-jet head is obtained.

As mentioned above, in the above-described method, as the gap spacers 4 and electrodes 3 are formed from the same layer (polysilicon layer), the gap shape and depth can be controlled well and the gaps can be formed uniformly. Thereby, it is possible to form the zero gap non-parallel shapes by which smooth contact is rendered. However, when the gap spacers 4 and electrodes 3 were made from different layers, some steps of positive/negative would have been generated, as will be described now.

Figure 6A:
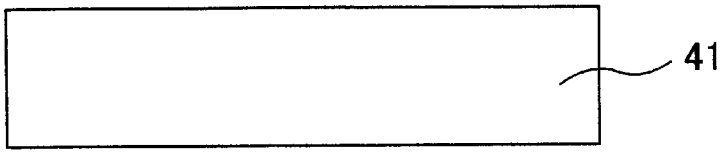
FIGS. 6A, 6B, 6C, 7A, 7B and 7C illustrate comparison examples to the above-mentioned first embodiment.
Figure 6B:
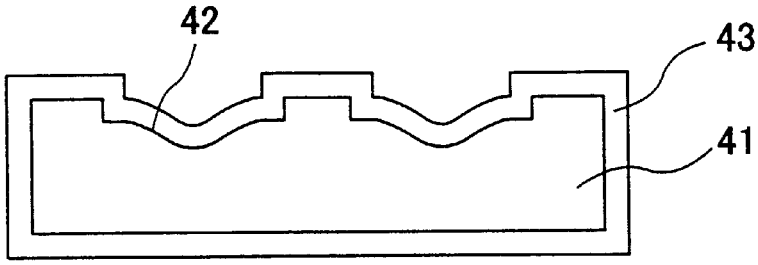
Figure 6C:
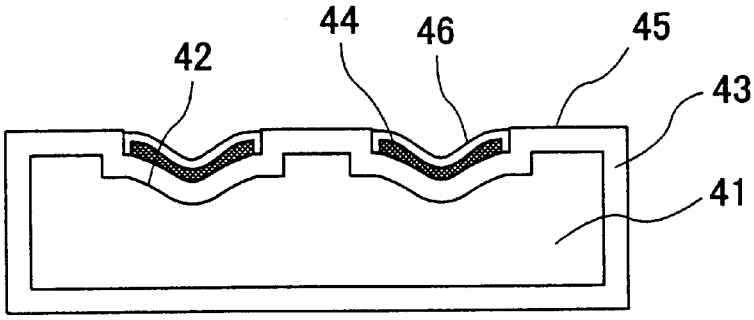
Figure 7A:
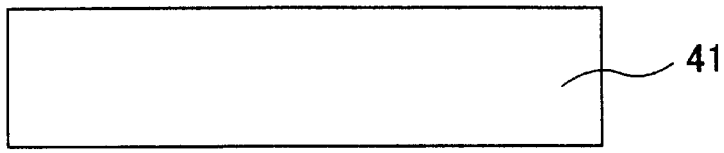
Figure 7B:
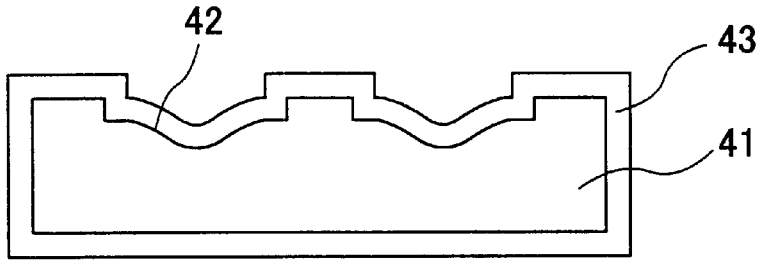
Figure 7C:
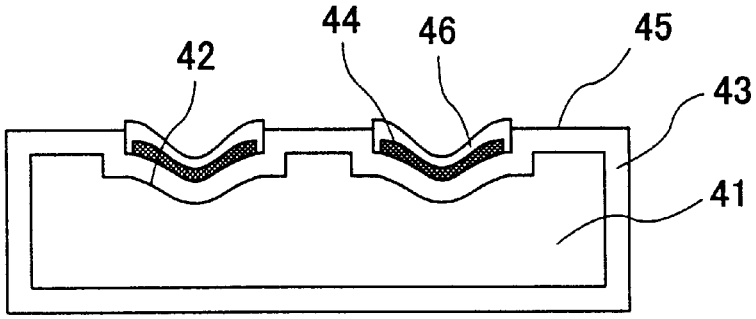

FIGS. 6A through 6C and 7A through 7C illustrate this matter. That is, recesses 42 are formed into silicon base body 41 for forming non-parallel gaps, thermal oxide film 43 are formed throughout the surface of the silicon base body 41, electrodes 44 are formed on the thermal oxide film 43, then, projecting parts of the thermal oxide film 43 are used as gap spacers 45, and protection insulating films 46 are formed on the surfaces of the electrodes 44. In this case, as shown in FIG. 6A through 6C, the protection insulating films 46 become lower than the gap spacers 45. Alternatively, as shown in FIG. 7A through 7C, the protection insulating films 46 become higher than the gap spacers 45. Thus, problematic vertical unevenness or steps are generated.

Even in such a case, it is possible to somewhat reduce such problematic vertical unevenness or steps by CMP (Chemical Mechanical Polishing) method or the like. However, polishing such as to reduce a considerably large amount of thickness may be needed for enabling the above-mentioned direct bonding. When a large amount of thickens is reduced by polishing, variation of gaps increases, so that practical electrostatic gaps cannot be rendered. In contrast thereto, when the gap spacers and electrodes 3 are formed from the same layer as in the embodiment of the present invention described above, it is possible to obtain a bonding surface by which the direct bonding is rendered after performing merely slight polishing thereonto.

Further, in the case where the process of forming the grooves 14 are performed after the surface polishing process, variation of electrostatic effective gaps becomes smaller and gap controllability becomes higher in comparison to a case where the process of forming the grooves 14 are performed before the surface polishing process. This is because, when forming the grooves is performed after the polishing, variation of electrostatic gaps occurring is never affected by variation in polishing amount. However, when forming of the grooves is performed before the surface polishing process, variation in polishing amount affects directly variation of air gaps, and, then, of the electrostatic effective gaps. Accordingly, it is preferable that forming of the grooves for forming the gaps are performed after surface polishing of the polysilicon film.

Figure 8:
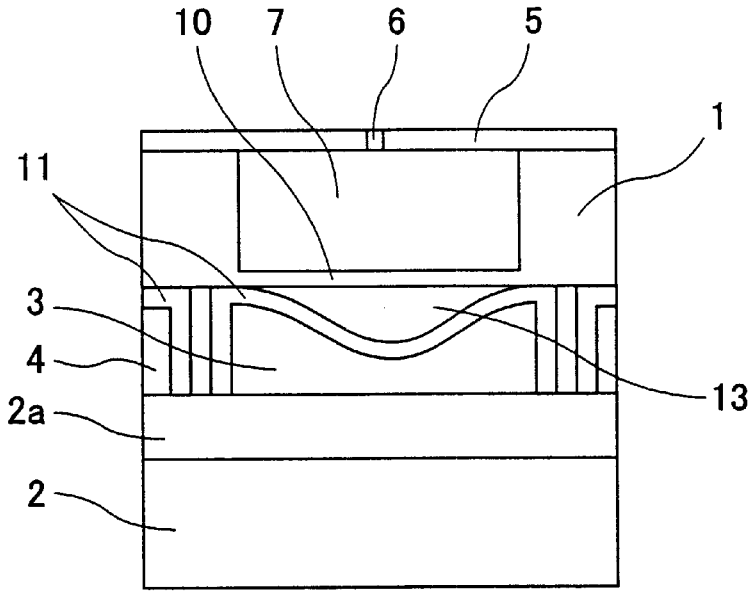
FIG. 8 illustrates another comparison example to the first embodiment.

Further, as described above, the oxide film 11 is formed on the side of the vibration plate as an insulating layer needed between the vibration plate 10 and electrodes 3, in the above-described example. In contrast to this, FIG. 8 shows another example in which an oxide film 11 is formed on a polysilicon film 23 after the surface polishing and formation of grooves. In this example, it is possible to more positively render insulation and protection of the particular electrodes 3. However, as the protection insulating film 11 is formed after the polishing, the surface roughness may become larger. Accordingly, this method is not preferable for the direct bonding.

However, even in this example, it may be possible to render the direct bonding in a case where formation of the oxide film 11 is performed by oxidation of polysilicon. In oxidation of polysilicon (polycrystalline silicon), differently from oxidation of silicon crystal (silicon substrate), as re-crystallization (grain growth) occurs due to thermal hysteresis, or as oxidation rate is different between polycrystalline grain surface and grain boundaries, the surface property may be degraded. However, in a case where polishing is performed after sufficient thermal hysteresis is given previously and thereby sufficiently grain growth is rendered, and/or in a case where the oxide film 11 is formed to be thinner, the direct bonding is not affected problematically. However, when the oxide film is formed of a deposition film, formed by CVD, spattering or the like, such as a high-temperature oxide film, a necessary surface property cannot be rendered, and, as a result, satisfactory direct bonding cannot be rendered therefrom.

Further, when the process of forming the grooves 14 becoming the non-parallel gaps is performed before the polysilicon film 23 is separated and split into particular electrodes 3, control of the non-parallel shape can be performed easily, in comparison to a case where the process of forming the grooves 14 becoming the non-parallel gaps is performed after the polysilicon film 23 is separated and split into particular electrodes 3. This is because the grooves for the non-parallel shapes greatly depend on the gradation pattern of resist. That is, after the separation of electrodes 3 is performed, it is not possible to coat resist uniformly due to influence of the separated regions, and, as a result, the gradation pattern of resist may have problematic variation.

Figure 9:
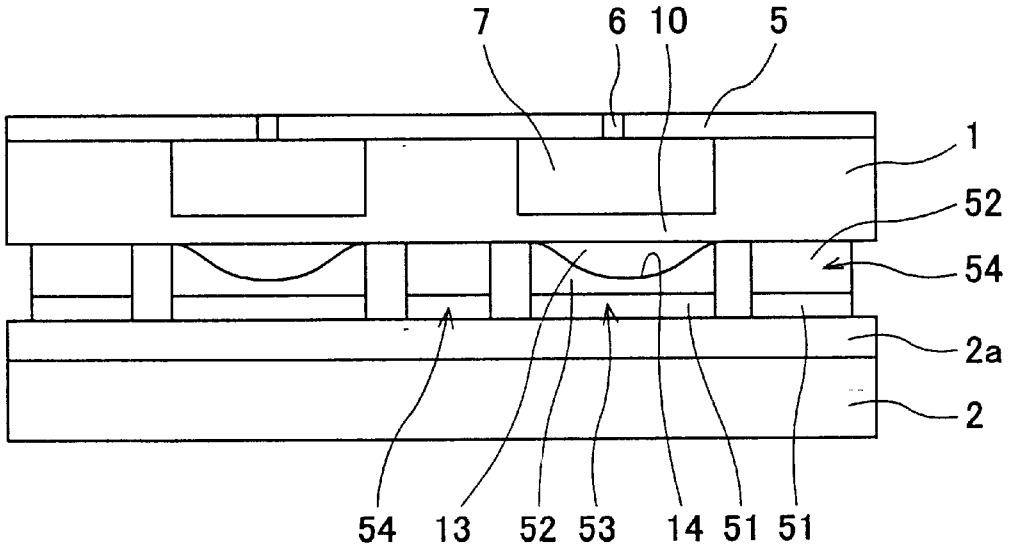
FIG. 9 shows a typical sectional view of an ink-jet head in a second embodiment of the present invention taken along a vibration-plate lateral direction.
Figure 10:
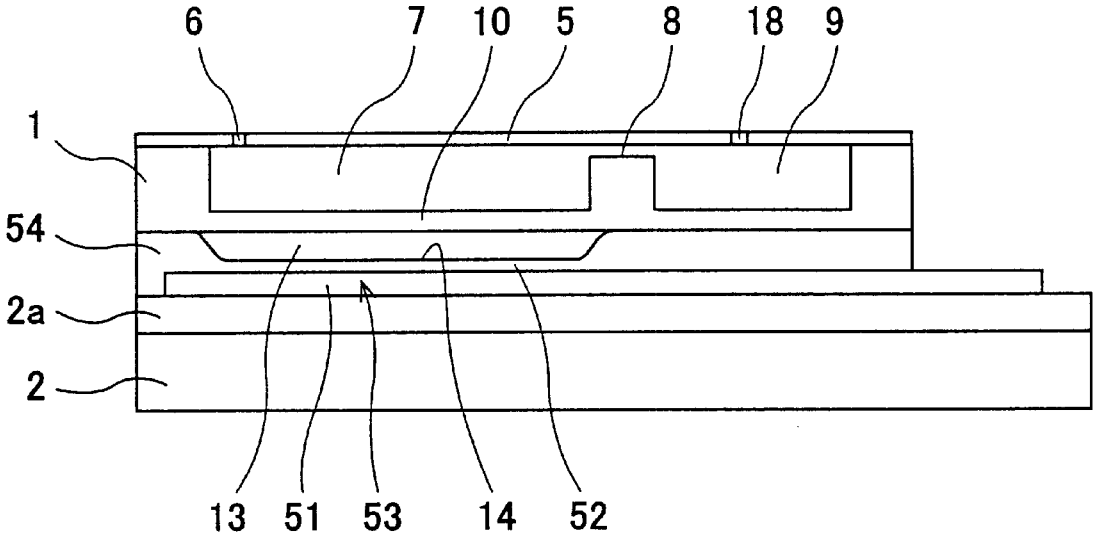
FIG. 10 shows a typical sectional view of the same ink-jet head taken along a vibration-plate longitudinal direction.

A second embodiment of the present invention will now be described with reference FIGS. 9 and 10. FIG. 9 shows a typical side-elevational sectional view taken along a short-side direction of vibration plate of the ink-jet head in the second embodiment, while FIG. 10 shows a typical side-elevational sectional view taken along a long-side direction of the vibration plate of the ink-jet head in the second embodiment.

This ink-jet head includes electrode parts 53 formed as a result of an oxide film 52 which is a protection insulating film for protecting electrodes (protection of the electrodes, and insulation between vibration plate and electrodes) being formed and laminated onto the surface of a polysilicon film (polysilicon layer) which becomes the electrodes. Grooves 14 are formed into the oxide films 52 of the electrode parts 53. Similarly, also gap spacer parts 54 are formed of a lamination of the polysilicon film 51 and oxide film 52 same as those of the electrode parts 53. Further, no oxide film 11 is formed on the surface of the vibration plate of the vibration-plate substrate 1 directed toward the electrodes. The other configuration is the same as that of the above-described first embodiment. The above-mentioned electrodes may be made not only of polysilicon but also of tungsten silicide or of titan silicide, or a limitation film of them.

As the above-mentioned oxide film 52, it is preferable to employ a polysilicon oxide film obtained from thermal oxidation of polysilicon, or a high-temperature oxide film (HTO) formed by thermal CVD at a high temperature. Further, other than them, as the protection insulating film, it is possible to employ, for example, LP-CVD nitride film, plasma oxide film, plasma nitride film, spattered insulating film, or a lamination film thereof. However, in these insulating films, the electron trapping level is high so that electrical degradation occurs earlier. In this case, the film thickness may be increased for reducing the electrical degradation. However, the electrostatic effective gaps increase thereby, and, as a result, the necessary driving voltage increases.

When the high-temperature oxide film or polysilicon oxide film is thus used as the protection film 52, high-accuracy gaps can be formed with satisfactory process yield without marring effective reduction of the necessary driving voltage, although the grooves 14 for the gaps 13 are formed into the protection film 52.

A method of manufacturing the above-described ink-jet head in the second embodiment of the present invention will now be described with reference to FIGS. 11A through 11D, and 12A through 12C.

Figure 11A:
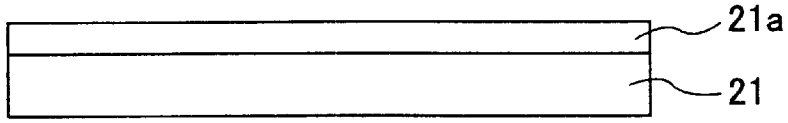
FIGS. 11A, 11B, 11C, 11D, 12A, 12B and 12C illustrate a manufacturing process of the same head.

First, as shown in FIG. 11A, a base oxide film 21*a* for rendering insulation between a base body 21 and electrodes 3 which are the particular electrodes is formed on the silicon base body 21 (employing a silicon wafer) becoming a base substrate for supporting the particular electrodes. In this case, as the oxide film 21*a,* a thermal oxide film having a thickness on the order of 0.5 through 2.0 $\mu$m is used. However, the type of the film and method of forming it are not limited thereto. Further, although it is preferable that the thickness of the film is relatively larger in order to reducing the capacitance coupling between the electrodes, this should not be limited this manner and should be determined appropriately according to the capacitance and resistance for each bit (for each nozzle), and the capacity and voltage of a driver (circuit) driving the ink-jet head.

Figure 11B:
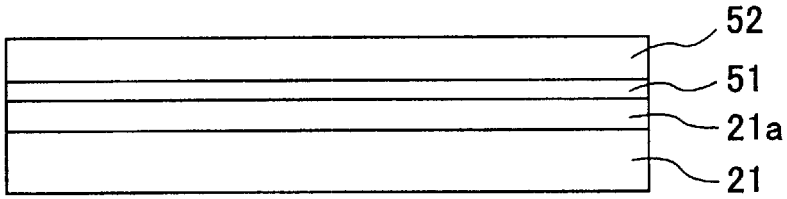

Then, as shown in FIG. 11B, a polysilicon film (polysilicon layer) 51 is formed on the oxide film 21*a* of the base body 21. In this case, phosphorus is provided into the polysilicon film 51 by ion implantation and thermal diffusion for the purpose of impurity placement for reducing the electric resistivity. However, it is not necessary to be limited to this manner. However, as the ion implantation method renders the smallest micro-roughness of the surface of silicon, it is preferable to employ the ion implantation method in case of forming the oxide film from polysilicon oxide film.

Then, an oxide film 52 is formed onto this polysilicon film 51. It is preferable that this oxide film 52 is a polysilicon oxide film or a high-temperature oxide film as described above. Then, the surface of this oxide film 52 is made to undergo mirror polishing. This process is performed for the purpose of improving the morphology of the surface, and, thereby, enabling easy direct bonding between the silicon base body 21 and a silicon base body 31 becoming a vibration-plate substrate which will be described later. This process is performed for the purpose of improving the morphology of the surface, and polishing should be performed so that the micro-roughness of the polished surface becomes such that the surface morphology is not more than the order of 1 nm. Practically, a polishing amount on the order of 0.005 through 0.2 $\mu$m results in a necessary polished surface. The above-mentioned polishing amount should be determined appropriately depending on the morphology of the surface of the oxide film, and is not limited to the above-mentioned range. The morphology of the surface of the oxide film depends on a method of forming it, a film thickness, and so forth, and setting of the polishing amount appropriately according thereto is needed.

Similarly to the above-mentioned case, when the above-mentioned polishing process were not performed, a bonding strength results from the direct bonding would have been degraded remarkably, many voids would have been generated in the bonding surface, and, in an extreme case, the bonding could not have been rendered at all. In a case of the present invention, it is necessary that the bonding strength is needed such that the bonded member is prevented from being removed during the subsequent processes. Accordingly, according to experiment, such bonding can be rendered when the surface morphology is in a range not exceeding 1 nm.

Figure 11C:
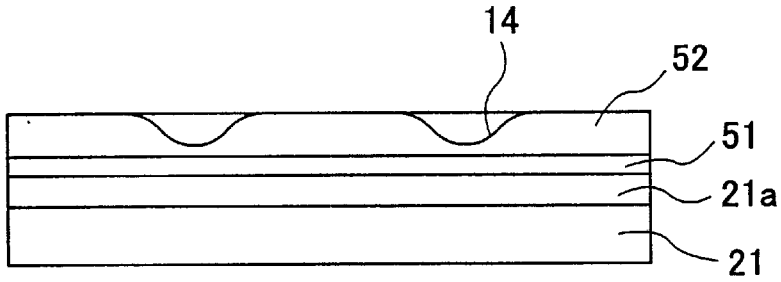

Then, as shown in FIG. 11C, in the surface of the oxide film 52 corresponding to the electrode parts, grooves 14 becoming electrostatic gaps 13 are formed. These grooves 14 have configurations such that each of the gaps 13 will have a sectional shape of a non-parallel gap in which at least one side portion thereof has an inclined outline smooth without any vertical steps (in this case, a non-parallel gap in which at least one side portion thereof starts from the gap length of 0). Specifically, each groove 14 has a configuration such that a gap 13 resulting therefrom has a Gaussian distribution shape as described above.

Such a shape of each groove 14 formed into the oxide film 52 can be rendered by the following processes similar to those for the above-described first embodiment for forming the grooves into the electrodes 3: First, a mask having a gradation pattern according to necessary groove depth is produced; a resist pattern corresponding to the necessary groove depth is formed by using the thus-produced mask; and the thus-formed resist pattern is transferred to the oxide film 52 by dry-etching method. In this case, setting is made such that the etching rate for the resist is normally higher than the etching rate for the oxide film 52. However, as the transfer may not be necessarily rendered simply in proportion to the ratio of the etching rates, appropriate setting of resist shape and etching requirement should be made each time according to a particular desired shape.

Figure 11D:
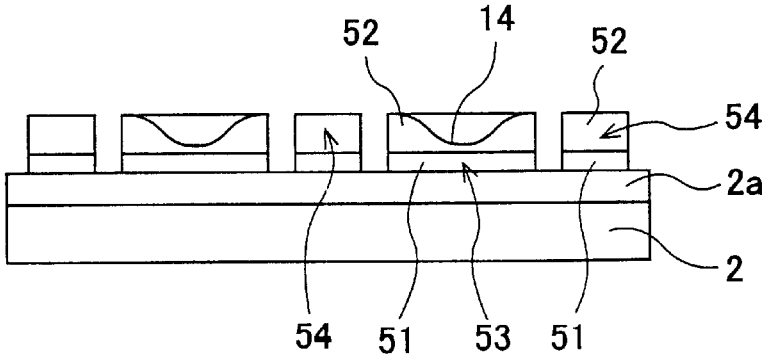

Then, as shown in FIG. 11D, resist is coated or laminated on the oxide film 52, a mask pattern having necessary openings is formed by photoengraving method, etching of the oxide film 52 and polysilicon film 51 is performed, the oxide film 52 and polysilicon film 51 are separated/split into the particular electrode parts 53, in which the oxide films 52 are formed on the surfaces of the electrodes made of the polysilicon films 51, and gap spacer parts 54, and, thus, the base substrate 2 on which the electrode parts 53 and gap spacer parts 54 having the same layer configuration are provided is obtained.

Thus, by forming the gap spacer parts 54 of the same material (in this case, the same layer configuration) as that of the electrodes and protection insulating films (electrode parts 53), the direct bonding therewith is enabled as a result of merely slight surface polishing being performed thereon. Further, the gap shape and depth can be controlled well and the gaps 14 can be formed uniformly. Thereby, it is possible to easily form the grooves for the non-parallel gaps which enable smooth contact and include zero gaps.

Figure 12A:
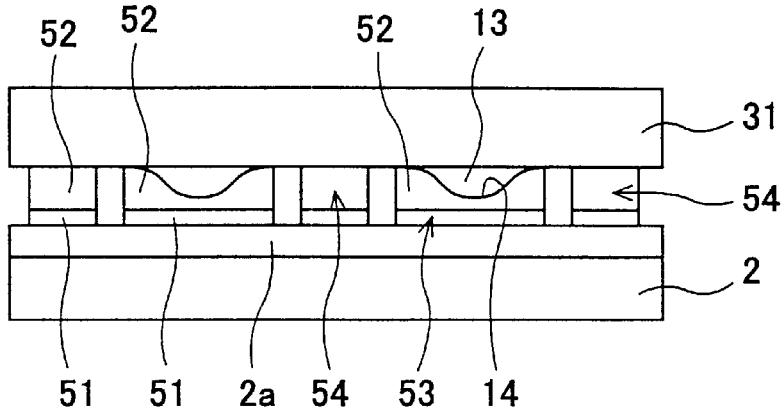

Then, as shown in FIG. 12A, a silicon base body 31 forming the vibration-plate substrate 1 is bonded onto the base substrate 2 (more specifically, the gap spacer parts 54). In this case, because the electrode parts 53 include the oxide films 52 acting as the protection insulating films, no oxide film is formed on the side of the vibration plate 10. However, it is preferable to form an oxide film, even having merely a slight thickens, thereonto in order to prevent the protection insulating film for protecting the electrodes from being degraded.

Figure 12B:
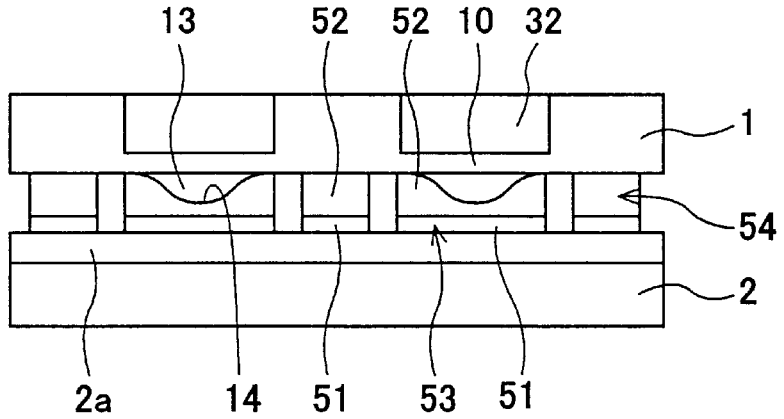

Then, as shown in FIG. 12B, recesses 32 are formed into the silicon base body 31 for a flow-path pattern for the liquid chambers 7 and so forth, the liquid chambers 7, vibration plate 10 and so forth are formed, and, thus, the vibration-plate substrate 1 is obtained. In this case, a silicon substrate having a crystal plane orientation (110) is used as the silicon base body 31, and, anisotropic etching is performed with KOH solution on the order of 10 wt % through 30 wt %. A mask used in the anisotropic etching is formed as a result of patterning a nitride film formed by reduced pressure CVD or plasma CVD, or a laminated film made of an oxide film and the above-mentioned nitride film.

Figure 12C:
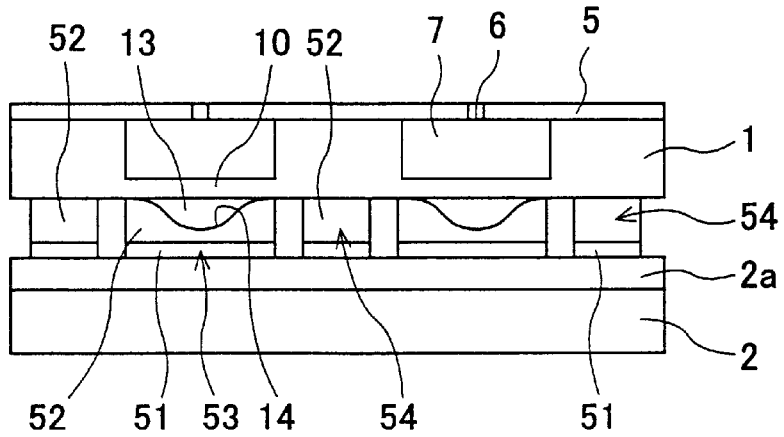

Then, as shown in FIG. 12C, the nozzle plate 5 is bonded onto the vibration-plate substrate 1, and, thus, the ink-jet head is obtained.

As mentioned above, in the above-described method, as the gap spacer parts 54 and electrode parts 53 (electrodes and protection insulating films) are formed from the same layer configuration, the gap shape and depth can be controlled well and the gaps can be formed uniformly. Thereby, it is possible to easily form the zero gap non-parallel shapes by which the smooth contact is rendered. However, when the gap spacer parts 54 and electrode parts 53 were made from different layer configurations, some vertical steps of positive/negative (lifting/lowering) would have been generated.

Figure 13A:
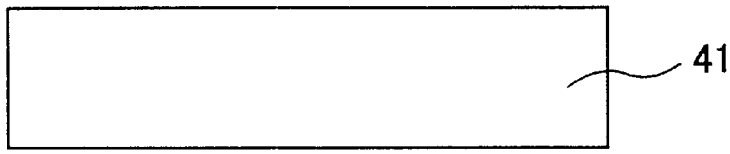
FIG. 13A, 13B, 13C, 14A, 14B and 14C illustrate comparison examples to the above-mentioned second embodiment.
Figure 13B:
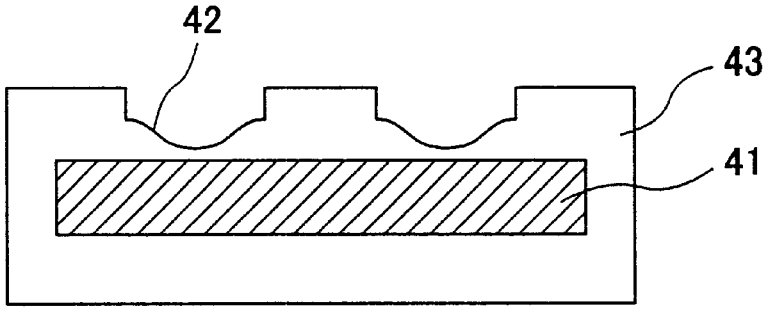
Figure 13C:
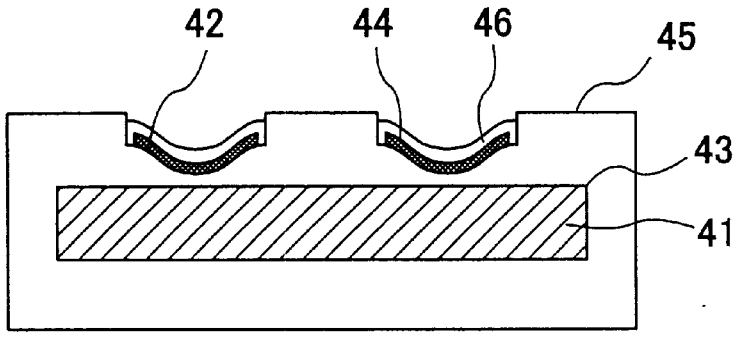
Figure 14A:
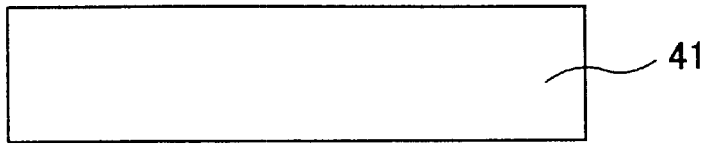
Figure 14B:
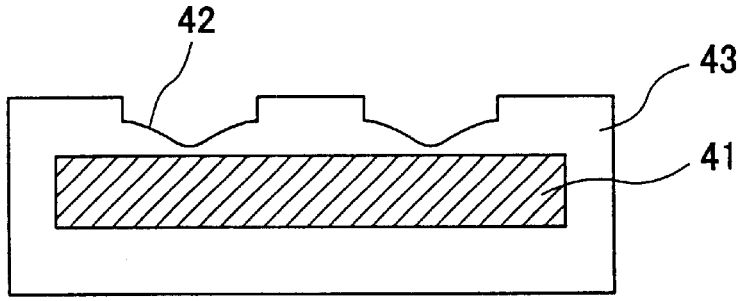
Figure 14C:
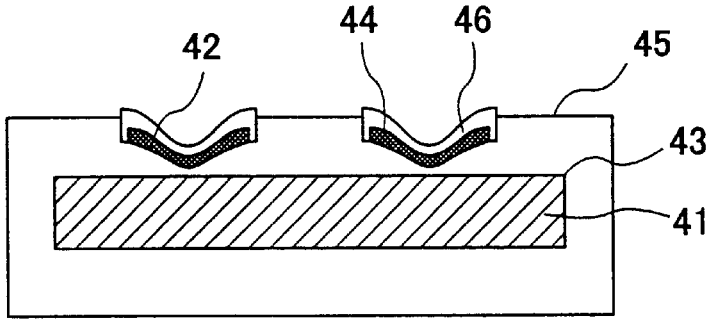

FIGS. 13A through 13C and 14A through 14C illustrate this matter. That is, an oxide film 43 is formed on the surface of a silicon base body 41, recesses 42 are formed into the oxide film 43 for forming non-parallel gaps, electrodes 44 are formed on bottom surfaces of the recesses 42, then, the tops of the oxide films 43 are used as gap spacer parts 45, and protection insulating films 46 are formed on the surfaces of the electrodes 44. In this case, as shown in FIG. 13A through 13C, the protection insulating films 46 become lower than the gap spacers 45. Alternatively, as shown in FIG. 14A through 14C, the protection insulating films 46 become higher than the gap spacers 45. Thus, problematic vertical unevenness or steps are generated.

Even in such a case, it is possible to somewhat reduce such problematic unevenness or steps by CMP (Chemical Mechanical Polishing) method or the like. However, polishing performed so as to reduce a considerably amount of thickness may be needed for enabling the effective direct bonding. When a large amount of thickens is thus reduced by polishing, variation of gaps increases, so that practical electrostatic gaps cannot be formed. In contrast thereto, when the gap spacer parts 54 and electrode parts 53 are formed from the same layer configuration as in the second embodiment of the present invention described above, it is possible to obtain a bonding surface by which the effective direct bonding is enabled merely by performing slight polishing thereonto.

Further, in the case where the process of forming the grooves 14 into the oxide film 52 are performed after the surface polishing process, variation of electrostatic effective gaps becomes smaller and gap controllability becomes higher in comparison to a case where the process of forming the grooves 14 are performed before the surface polishing process. This is because, when forming the grooves is performed after the polishing, variation in polishing amount becomes variation in the oxide film 52. When forming of the grooves is performed before the surface polishing process, the variation in polishing amount results directly in variation of the air gaps. As the dielectric constant of oxide film (specific inductive capacity: 3.8) is approximately 4 times that (specific inductive capacity: 1) of air, it is possible to reduce the substantial/effective variation into ¼ as a result of forming the grooves after the surface polishing.

Further, when the process of forming the grooves 14 becoming the non-parallel gaps is performed before the polysilicon film 51 and oxide film 52 are separated and split into the particular electrode parts, control of the resulting non-parallel shape can be performed easily, in comparison to a case where the process of forming the grooves 14 becoming the non-parallel gaps is performed after the polysilicon film 51 and oxide film 52 are separated and split into the particular electrode parts. This is because the grooves for the non-parallel shapes greatly depend on the gradation pattern of resist. That is, after the separation of electrode parts is performed, it is not possible to coat the resist uniformly due to influence of the separated regions (recesses), and, as a result, the gradation pattern of the resist may have problematic variation.

Figure 15A:
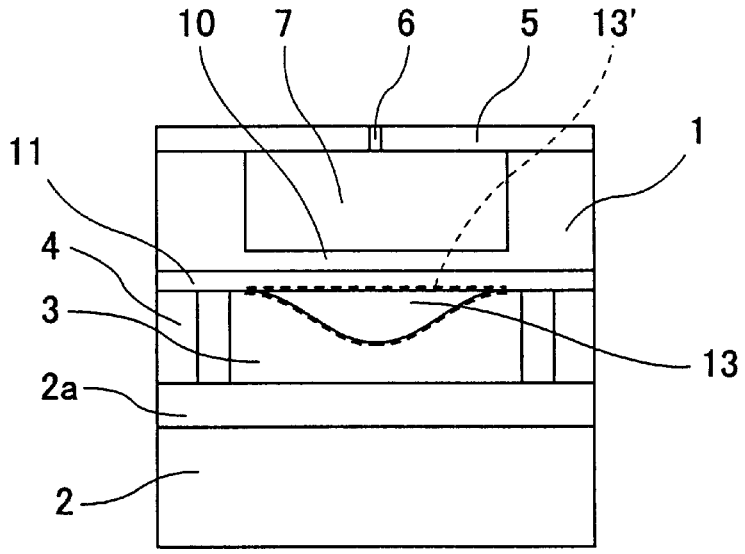
FIGS. 15A and 15B illustrates the above-mentioned first embodiment for comparison between the first and second embodiments.
Figure 15B:
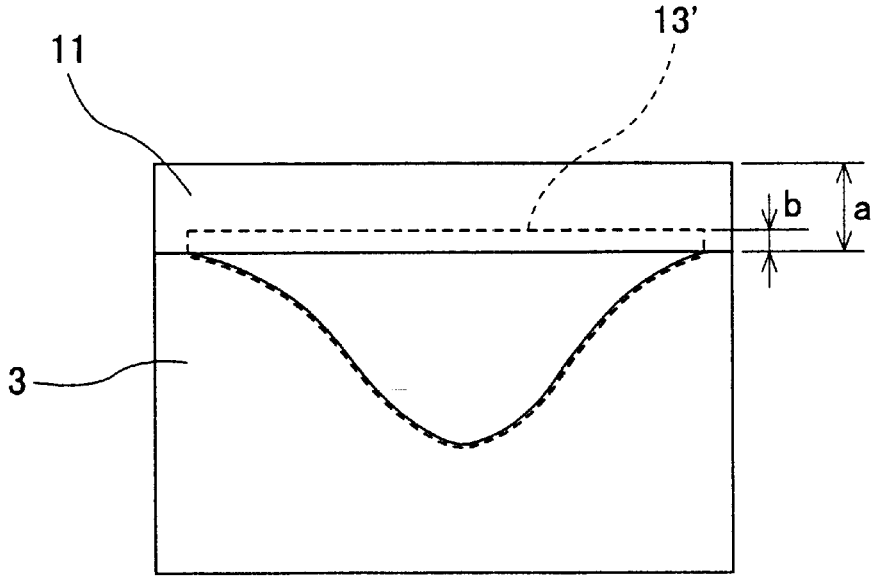
Figure 16A:
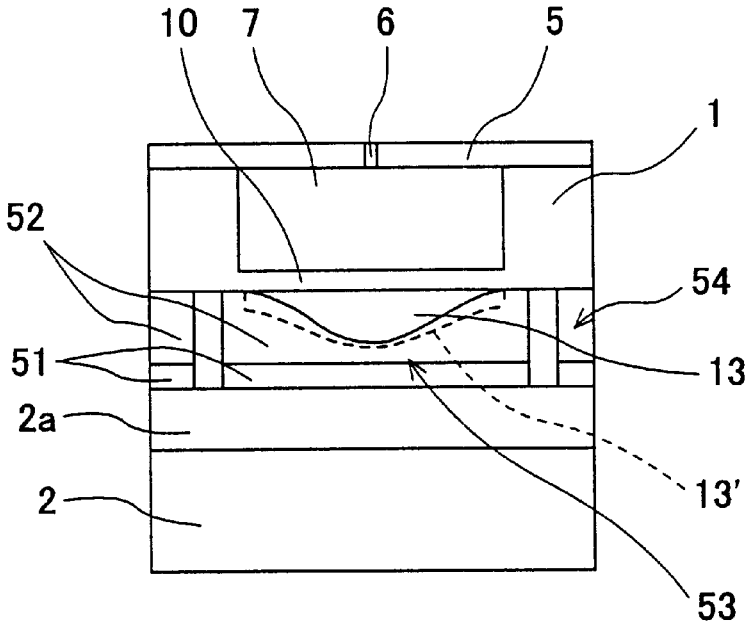
FIGS. 16A and 16B illustrates the above-mentioned second embodiment for comparison between the first and second embodiments.
Figure 16B:
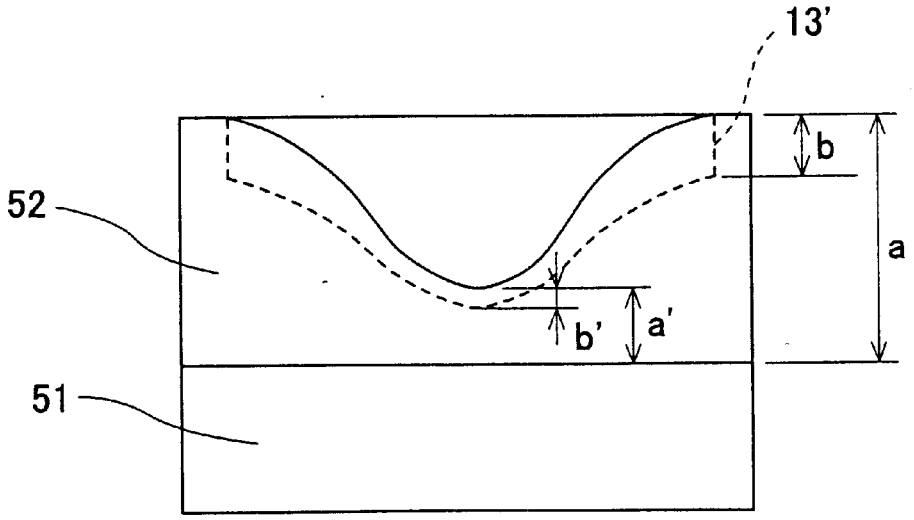

Difference between the above-described first and second embodiments of the present invention will now be described with reference to FIGS. 15A, 15B and FIGS. 16A and 16B. FIG. 15A shows an essential sectional view of the first embodiment taken along the vibration-plate short-side direction; FIG. 15B shows a partial magnified view of FIG. 15A; and, FIG. 16A shows an essential sectional view of the second embodiment taken along the vibration-plate short-side direction; FIG. 16B shows a partial magnified view of FIG. 16A.

In the standpoint of driving-voltage reduction effect, the first embodiment does not have the oxide film 52 in the non-parallel bottom line of the electrode 3 although the second embodiment has it there, and, also, the oxide film 11 is thinner than the oxide film 52. Accordingly, in this standpoint, the first embodiment is more advantageous. That is, broken lines in FIGS. 15A, 15B, 16A and 16C typically show the electrostatic effective gaps 13' in these embodiments. As can be seen from comparison between these electrostatic effective gaps 13', in the first embodiment, the electrostatic effective gap corresponds a combined capacitance of the non-parallel air gap and oxide film (insulating film) 11, while, in the second embodiment, the electrostatic effective gap corresponds to a combined capacitance of the non-parallel air gap and protection insulting film 52 having the recess shape. In FIGS. 15A, 15B, 16A and 16B, a:b=a':b'=4:1.

On the other hand, in the standpoint of controllability of shape and depth of the gaps, the second embodiment is more advantageous. This is because, controllability for dry etching by the gradation patterning is better in silicon or polysilicon than in oxide film. In addition, oxide film is somewhat superior in controllability of polishing amount as etching rate in polishing can be set lower in oxide film.

Figure 17:
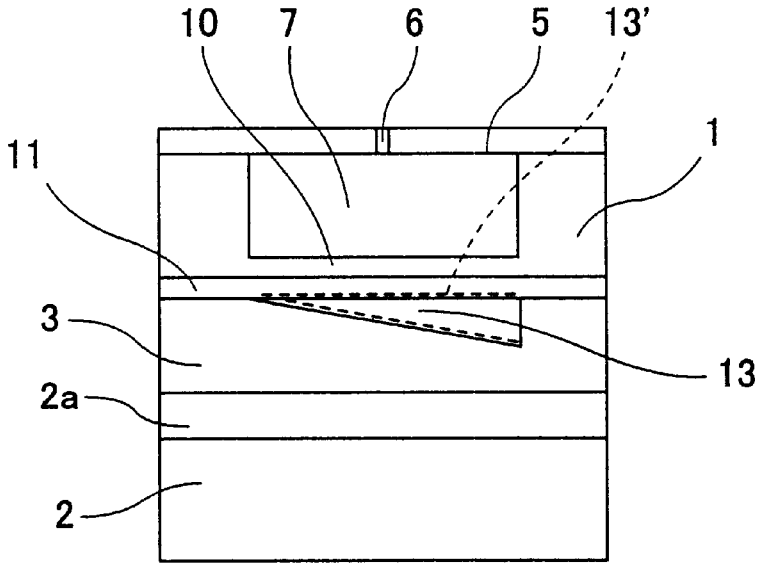
FIG. 17 shows a typical sectional view of a variation embodiment of the above-mentioned first embodiment, taken along the vibration-plate lateral direction.
Figure 18:
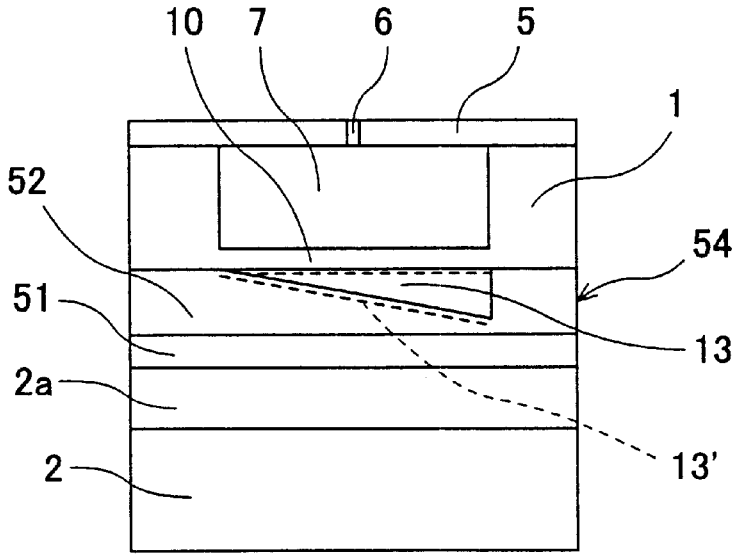
FIG. 18 shows a typical sectional view of a variation embodiment of the above-mentioned second embodiment, taken along the vibration-plate lateral direction.

With reference to FIGS. 17 and 18, embodiments having other gap shapes than those of the above-described first and second embodiments will now be described. FIG. 17 shows an essential sectional view of the embodiment corresponding to the first embodiment taken along the vibration-plate short-side (lateral) direction, while FIG. 18 shows an essential sectional view of the embodiment corresponding to the second embodiment taken along the vibration-plate short-side (lateral) direction.

In each of these embodiments, the shape of the bottom surface of the groove 14 for forming the gap 13 has a straight-line single-directional inclined shape. Although the above-described Gaussian shape would be the most advantageous for effectively reducing the driving voltage, smooth contact (the vibration plate 10 is deformed and comes into contact with the electrode 3 or the protection insulating film formed on the surface of the electrode 3) may not be rendered therefrom. In contrast thereto, the smooth contact deformation can be rendered by this straight-line single-directional inclined shape bottom surface of the gap.

Figure 19:
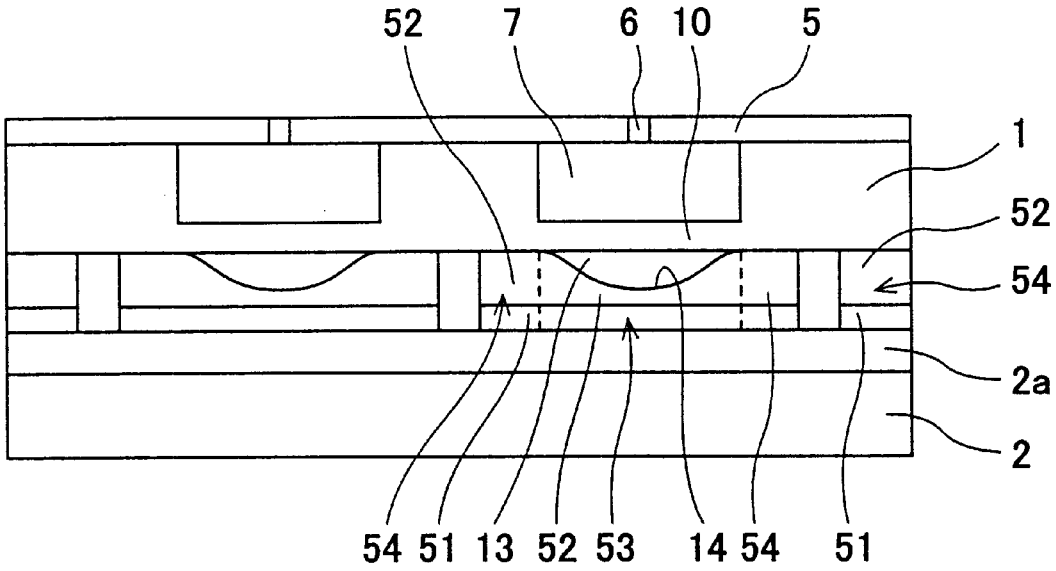
FIGS. 19 shows a typical sectional view of an ink-jet head in a third embodiment of the present invention taken along a vibration-plate lateral direction.
Figure 20:
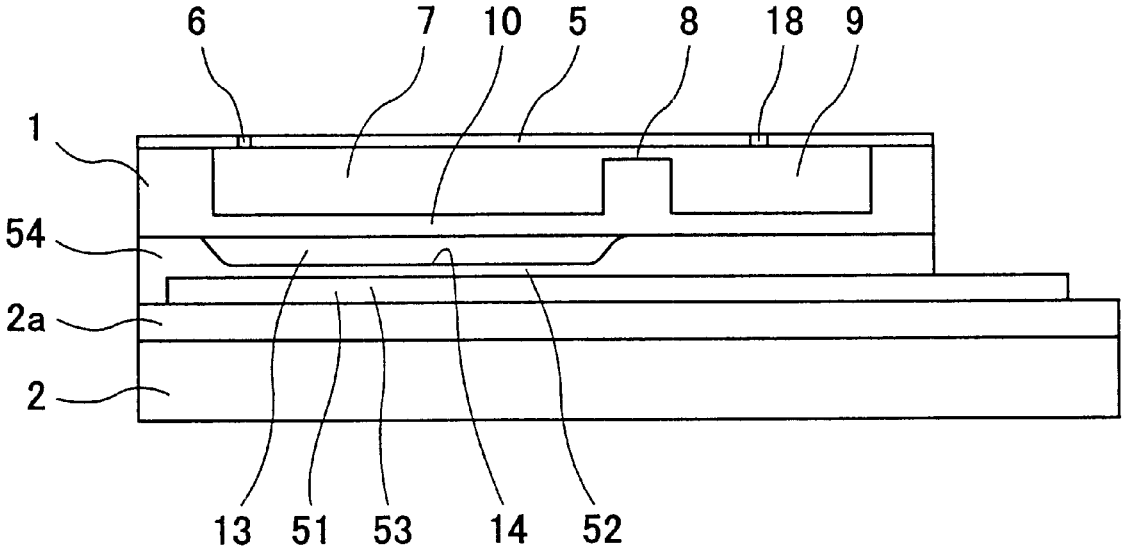
FIG. 20 shows a typical sectional view of the same ink-jet head taken along a vibration-plate longitudinal direction.

Then, a third embodiment of the present invention will now be described with reference to FIGS. 19 and 20. FIG. 19 shows a typical magnified front elevational sectional view of an ink-jet head in the third embodiment taken along a vibration-plate short-side direction, while FIG. 20 shows a typical magnified side elevational sectional view of the same ink-jet head taken along a vibration-plate long-side direction.

In this ink-jet head, similar to the above-described second embodiment, the electrode part 53 is formed of a laminated member of the polysilicon film 51 becoming the electrode and the oxide film 52 which is the protection insulating film for protecting the electrode (insulation between the vibration plate and electrode), and, the grove 14 is formed into the oxide film 52. Similarly, the gap spacer part 54 is formed of a laminated member of the polysilicon film 51 and oxide film 52.

Further, as a result of the width of the electrode part 53 is made longer than the width of the groove 14, parts of the electrode part 53 (parts outside of the groove 14: parts defined by broken lines in FIG. 19) are used as the gap spacer parts 54. The other configuration is the same as that of the second embodiment.

As the oxide film 52, it is preferable to employ a polysilicon oxide film obtained from thermal oxidation of polysilicon, or a high-temperature oxide film (HTO) formed by thermal CVD at a high temperature. As the protection insulating film, it is also possible to employ, for example, an LP-CVD nitride film, a plasma oxide film, a plasma nitride film, a spattered insulating film, a lamination film thereof, or the like. However, in these insulating films, the electron trapping level is high so that electrical degradation develops earlier. In this case, the film thickness may be increased for reducing the electrical degradation. However, the electrostatic effective gap increases thereby, and, as a result, the necessary driving voltage increases.

As mentioned above, the parts of the electrode 53 are used as the gap spacer parts 54 in the third embodiment. In other words, the gap spacer parts 54 are integral with the electrode and protection insulating film. Thereby, controllability of the gap is improved, and, thus, the process yield increases.

A method of manufacturing the above-described ink-jet head in the third embodiment of the present invention will now be described with reference to FIGS. 21A through 21D, and 22A through 22C.

Figure 21A:
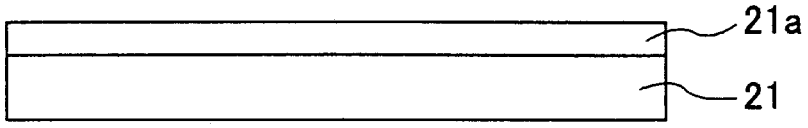
FIGS. 21A, 21B, 21C, 21D, 22A, 22B and 22C illustrate a manufacturing process of the same head.
Figure 21B:
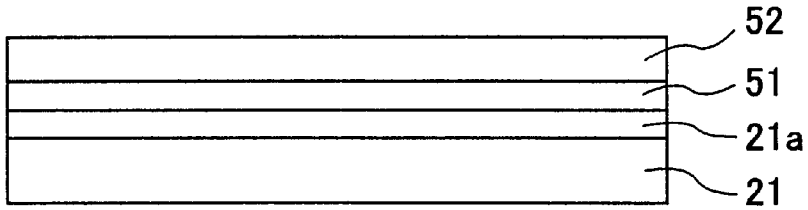
Figure 21C:
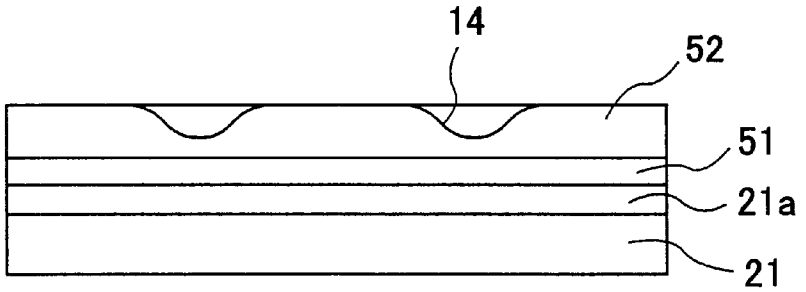

First, as shown in FIGS. 21A through 21C, similar to the above-described manufacturing process for the second embodiment, a base oxide film 21*a* for rendering insulation between a base body 21 and electrodes 3 which are particular electrodes is formed on a silicon base body 21 (employing a silicon wafer) becoming a base substrate for supporting the particular electrodes. Then, a polysilicon film (polysilicon layer) 51 is formed on the oxide film 21*a* of the base body 21. Then, an oxide film 52 as a protection insulating film is formed onto this polysilicon film 51. It is preferable that this oxide film 52 is a polysilicon oxide film or a high-temperature oxide film as described above. Then, the surface of this oxide film 52 is made to undergo mirror polishing. In the surface of the oxide film 52, grooves 14 becoming electrostatic gaps 13 each having Gaussian distribution shape are formed.

Figure 21D:
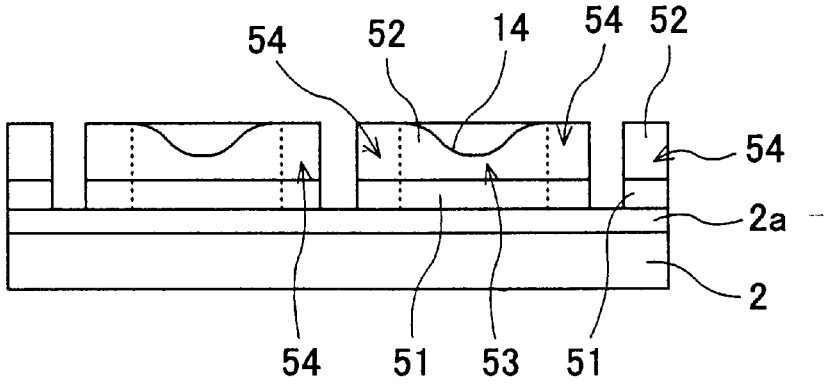

Then, as shown in FIG. 21D, resist is coated or laminated on the oxide film 52, and a mask pattern having necessary openings is formed by photoengraving method. In this case, in comparison to the mask pattern in the case of the second embodiment, a mask part of the mask pattern for forming the electrode part 53 is wider, so that the gap spacer parts 54 are formed integrally with the electrode part 53. Then, etching of the oxide film 52 and polysilicon film 51 is performed by using this mask pattern, they are separated/split into the particular electrode parts 53, in which the oxide films 52 are formed on the surfaces of the electrodes made of the polysilicon films 51, including gap spacer parts 54, and, thus, the base substrate 2 on which the electrode parts 53 and gap spacer parts 54 having the same layer configuration are provided is obtained.

Thus, by forming the gap spacer parts 54 of the same material (in this case, the same layer configuration) as that of the electrodes and protection insulating films (electrode parts 53), the effective direct bonding thereof is enabled merely as a result of slight surface polishing being performed thereon. Further, the gap shape and depth can be controlled well and the gaps 14 can be formed uniformly. Thereby, it is possible to easily form the grooves for the non-parallel gaps which include zero gaps and enable the smooth contact.

Figure 22A:
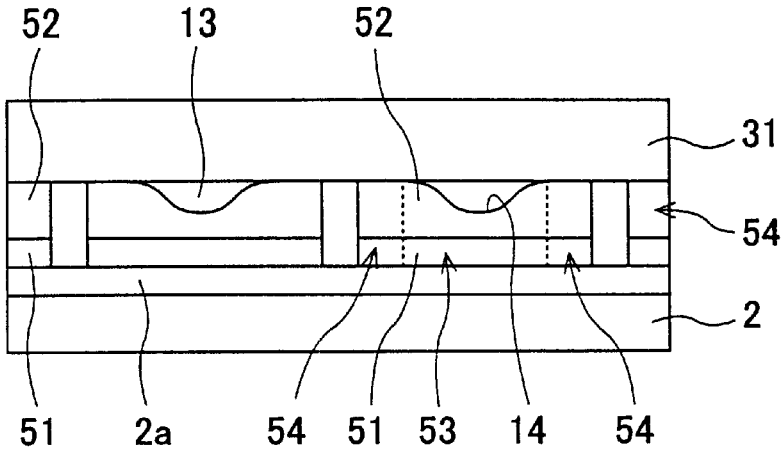

Then, as shown in FIG. 22A, a silicon base body 31 forming the vibration-plate substrate 1 is bonded onto the base substrate 2 (more specifically, the gap spacer parts 54). Also in this case, because the electrode parts 53 include the oxide films 52 acting as the protection insulating films, no oxide film is formed on the side of the vibration plates 10. However, it is still preferable to form an oxide film, even having a slight thickness, thereonto in order to prevent the protection insulating film for protecting the electrodes from being degraded.

Figure 22B:
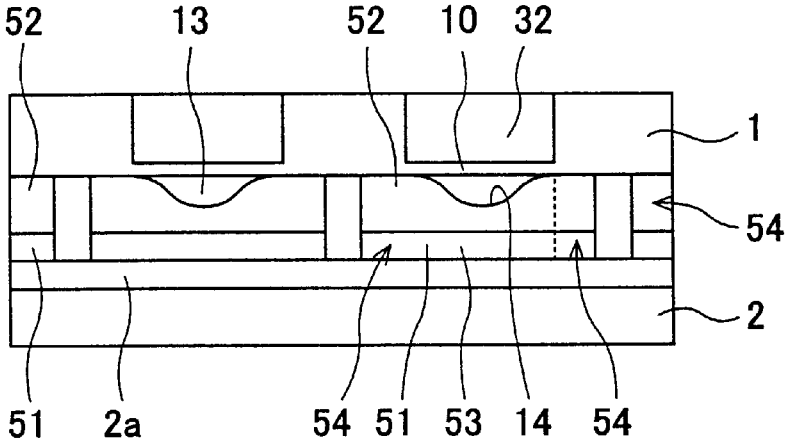

Then, as shown in FIG. 22B, recesses 32 are formed into the silicon base body 31 for a flow-path pattern for the liquid chambers 7 and so forth, the liquid chambers 7, vibration plate 10 and so forth are formed, and, thus, the vibration-plate substrate 1 is obtained. In this case, a silicon substrate having a crystal plane orientation (110) is used as the silicon base body 31, and, anisotropic etching is performed with KOH solution on the order of 10 wt % through 30 wt %. A mask used in the anisotropic etching is formed as a result of patterning a nitride film formed by reduced pressure CVD or plasma CVD, or a laminated film made of an oxide film and the above-mentioned nitride film.

Figure 22C:
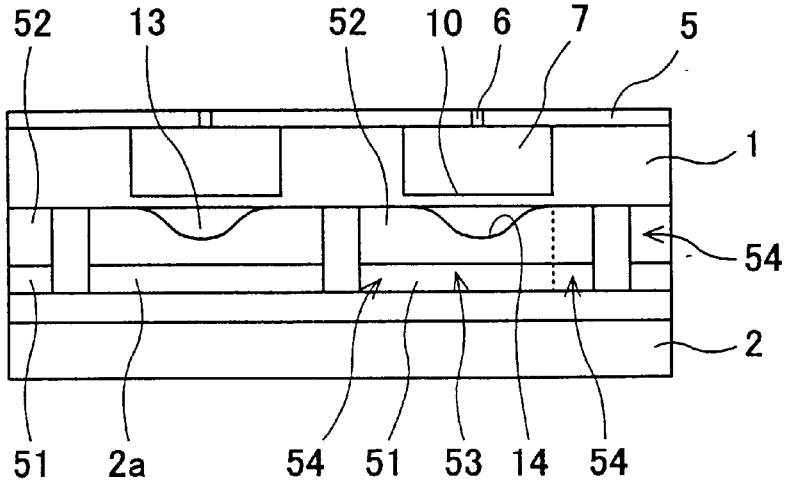

Then, as shown in FIG. 22C, the nozzle plate 5 is bonded onto the vibration-plate substrate 1, and, thus, the ink-jet head is obtained.

As mentioned above, in the above-described method, as the gap spacer parts 54 and electrode parts 53 are formed from the same layer configuration, the gap shape and depth can be controlled well and the gaps can be formed uniformly. Thereby, it is possible to easily form the zero gap non-parallel shapes by which the smooth contact is enabled, as described above. As the parts of the electrode part 53 are used as the gap spacer parts 54, it is possible to control the gap at a high accuracy. The other effects/advantages same as those of the second embodiment are also result from the third embodiment.

Figure 23:
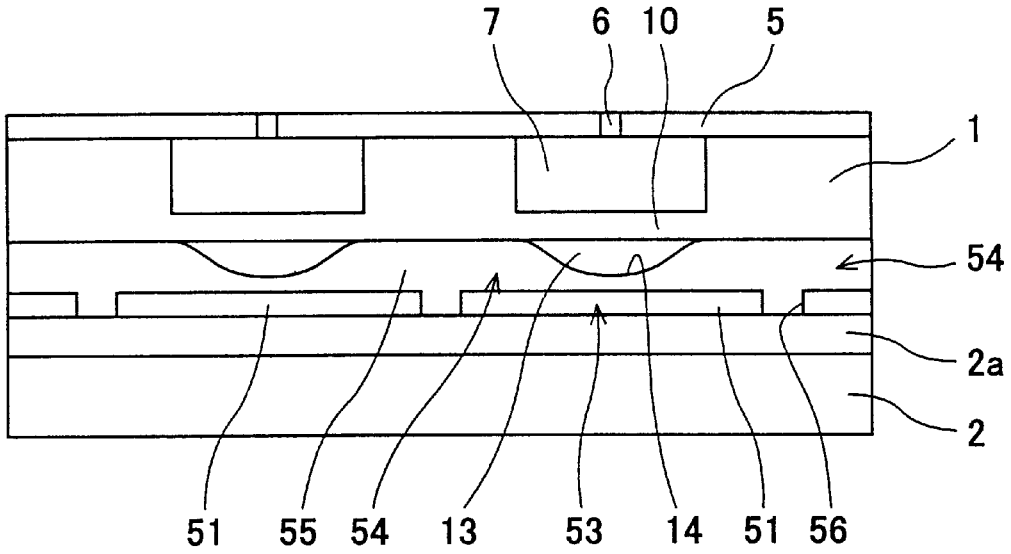
FIG. 23 shows a typical sectional view of an ink-jet head in a fourth embodiment of the present invention taken along a vibration-plate lateral direction.
Figure 24:
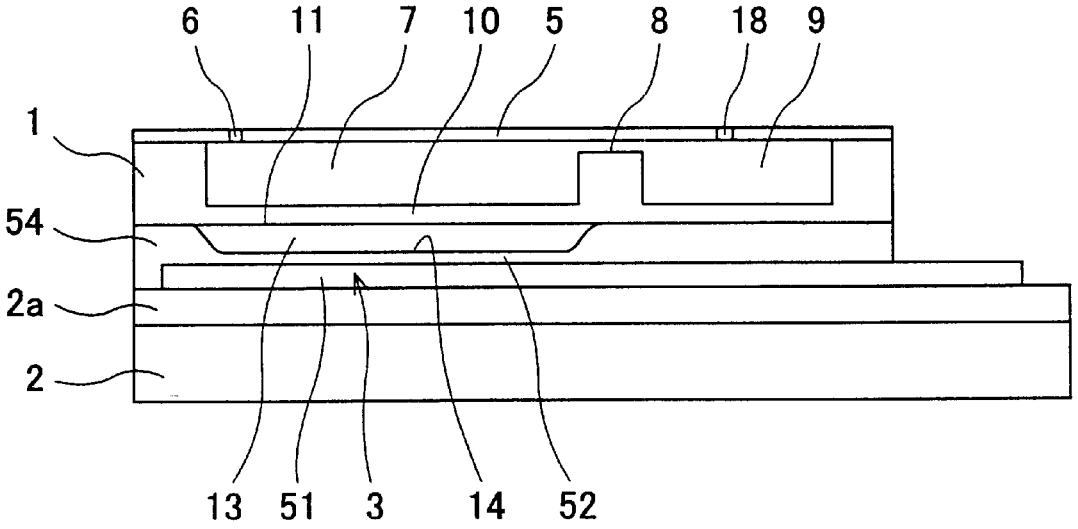
FIG. 24 shows a typical sectional view of the same ink-jet head taken along a vibration-plate longitudinal direction.

Then, a fourth embodiment of the present invention will now be described with reference to FIGS. 23 and 24. FIG. 23 shows a typical magnified front elevational sectional view of an ink-jet head in the fourth embodiment taken along a vibration-plate short-side/lateral direction, while FIG. 24 shows a typical magnified side elevational sectional view of the same ink-jet head taken along a vibration-plate long-side/longitudinal direction.

Also in this ink-jet head, an electrode part 53 has a laminated-layer configuration of a polysilicon film 51 becoming an electrode and a high-temperature oxide (HTO) film 55 formed by high-temperature thermal CVD and used as a protection insulating film for protecting the electrode (protection of the electrode and insulation between the vibration plate and the electrode), and, also, a groove 14 is formed into the high-temperature oxide film 55 facing the vibration plate 10. The other part of the electrode part 53 than the part for the groove is used as a gap spacer part 54. In this case, the electrode may be made not only of polysilicon but also of tungsten silicide, titan silicide, or a limitation film of them.

In this fourth embodiment, the high-temperature oxide film 55 is also present in a separate part 56 (recess) between the particular polysilicon films 51. Thereby, the high-temperature oxide film 55 is formed also on the side walls of the particular polysilicon film 51. Furthermore, the high-temperature oxide film 55 fills the separate part 56 between the polysilicon films 51. The other configuration is the same as that of the above-described third embodiment of the present invention.

If only a protection insulating film is to be formed also on the side walls of the polysilicon film 51 becoming the electrode, it would be possible to form the above-described polysilicon oxide film or the like thereon. However, in this embodiment, a protection insulating film fills the separate part 56 formed between the polysilicon films 51. Therefore, the high-temperature oxide film (HTO film) which is formed by high-temperature CVD is employed for the purpose. It is possible to enable the HTO film to fill the electrode separating groove (separate part 56) by making the electrode separating interval (width of the electrode separating groove) to be not longer than twice the thickness of the HTO film or making the thickness of the HTO film to be not shorter than half the electrode separating interval.

As a result of protecting even the side walls of the electrode by the oxide film (protection insulating film), the reliability of the resulting device is improved. Further, as a result of filling the separating groove (separating part) between the electrodes with the high-temperature oxide film, together with performing polishing thereafter, it is possible to embed the electrode completely. Thereby, it is possible to enable polishing process or formation of the gradation pattern to be performed after the electrode separating process. Thus, the process flexibility is improved.

Then, a manufacturing process for the above-described ink-jet head in the fourth embodiment will now be described with reference to FIGS. 25A through 25D and 26A through 26C.

Figure 25A:
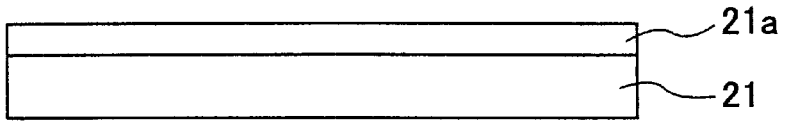
FIGS. 25A, 25B, 25C, 25D, 26A, 26B and 26C illustrate a manufacturing process of the same head.

First, as shown in FIG. 25A, a base oxide film 21*a* is formed on a silicon base body (silicon wafer is used) 21 for insulating between the base body 21 and the electrode 3 which acting as a particular electrode. The base body 21 is used for supporting the particular electrode. In this case, the base oxide film 21*a* is a thermal oxide film and has a thickness on the order of 0.5 through 2.0 $\mu$m. However, the type/formation method of the oxide film employed is not limited thereto.

Figure 25B:
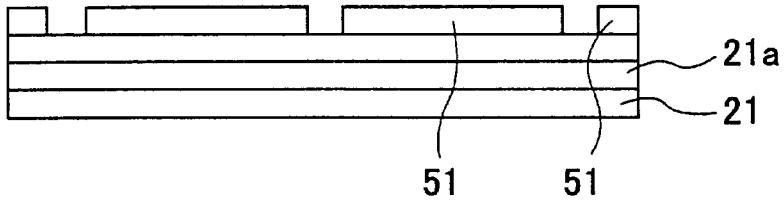

Then, as shown in FIG. 25B, a polysilicon film (polysilicon layer) 51 is formed on the oxide film 21*a* of the silicon base body 21. In this case, in this polysilicon film 51, phosphorous is ion-implanted and thermally diffused for the purpose of providing impurity for reducing the electric resistivity. Then, resist is coated or laminated on the polysilicon film 51, a mask pattern having necessary openings are formed therefrom by photoengraving method, etching is performed on the polysilicon film 51 using this mask pattern, and, thus, the polysilicon film 51 is separated into parts becoming particular electrodes and gap spacer parts.

Figure 25C:
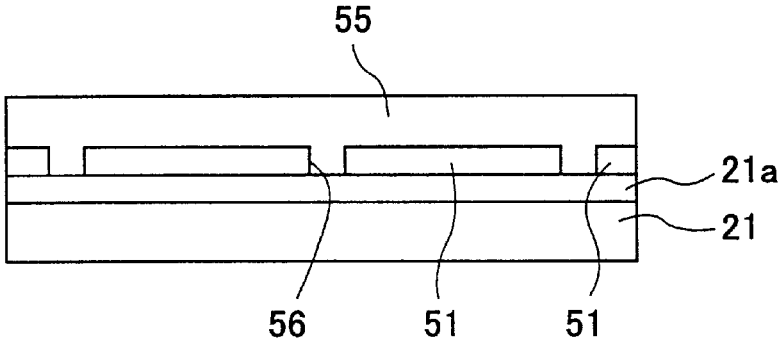

Then, as shown in FIG. 25C, the high-temperature oxide film (HTO film) 55 is formed on the thus-separated polysilicon films 51 and into the separate parts 56 present therebetween. Then, the surface of the thus-formed HTO film 55 is mirror-polished. This process is performed so that morphology of the surface is improved, and, thereby, the effective direct bonding between the silicon base body 21 and a silicon base body 31 described later to be the vibration-plate substrate is enabled. This process is thus performed for the purpose of improving the morphology of the surface as mentioned above, and the polishing should be performed so that the micro-roughness of the resulting polished surface becomes such that the surface morphology is not more than the order of 1 nm. Practically, a polishing amount on the order of 0.005 through 0.5 $\mu$m results in the required polished surface. The above-mentioned polishing amount should be determined appropriately depending on the morphology of the polysilicon, and is not limited to the above-mentioned range. The morphology of the polysilicon layer/film depends on a method of forming it (including a method of forming the film, a method of providing impurity thereinto, a method of activating the impurity and so forth), a film thickness, and so forth, and setting of the polishing amount therefor appropriately is needed. In addition, in this fourth embodiment, the electrode separating parts 56 are filled with the high-temperature oxide film 55, and, the above-mentioned polishing process is performed for the purpose of making the surface thereof completely flat. Accordingly, the thickness of the high-temperature oxide film 55 and the polishing amount are larger than those in the second and third embodiments.

Figure 25D:
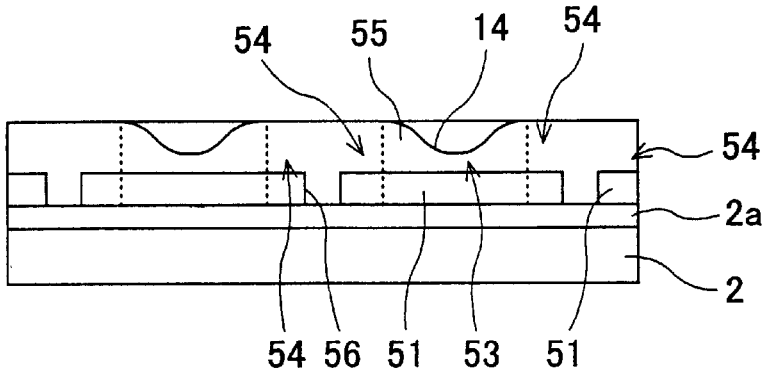

Then, as shown in FIG. 25D, in the surface of the high-temperature oxide film 55, grooves 14 becoming the gaps (electrostatic gaps) 13 are formed. Thus, a base substrate 2 is obtained. These grooves 14 have configurations such that each of the gaps 13 has a sectional shape of a non-parallel gap in which at least one side portion thereof has an inclined outline smooth without any vertical steps (in this case, a non-parallel gap in which at least one side portion thereof starts from the gap length of 0). Specifically, each groove 14 has a configuration such that a gap 13 resulting therefrom has a Gaussian distribution shape as described above.

Thus, by forming the gap spacer part 54 and electrode part 53 by the same material (in this case, the same layer), the effective direct bonding thereof is enabled merely as a result of slight surface polishing being performed thereon. Further, the gap shape and depth can be controlled well and the gaps 14 can be formed uniformly. Thereby, it is possible to easily form the groove for the non-parallel gap which includes a zero gap and enables the smooth contact. However, in the case where the electrode separating part 56 is filled with the high-temperature oxide film 55 and then complete flatting thereof is performed as mentioned above, it is necessary to somewhat increase the necessary polishing amount. In order to increase the polishing amount, it is necessary to previously increasing the thickens of the high-temperature oxide film to be formed. These amounts should be determined appropriately in accordance with the required thickness of the electrode layer 51, width of the electrode separating part 56, depth of the gap 13, and the thickness of the protection insulating film 53.

Figure 26A:
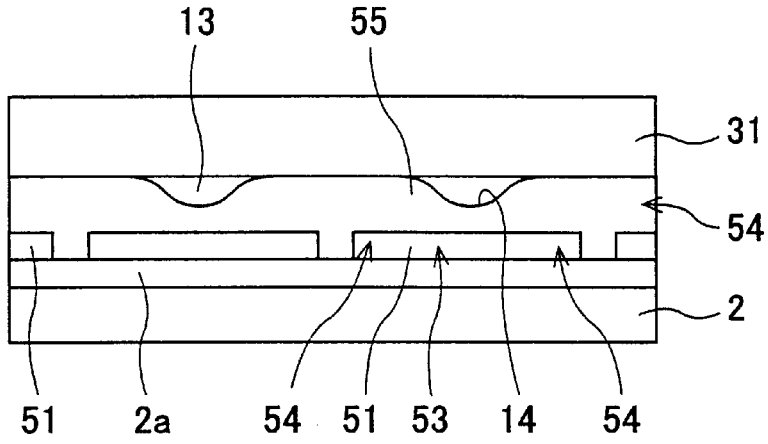

Then, as shown in FIG. 26A, the above-mentioned silicon base body 31 forming the vibration-plate substrate 1 is bonded onto the silicon base body 21 (more specifically, onto the gap spacer parts 54) holding the particular electrodes 3, by silicon direct bonding. In this case, because the high-temperature oxide film 55 which is the protection insulating film is formed in the electrode parts 53, no insulating film is formed on the side of the vibration plate 10. However, it is still preferable to form, even slightly, an oxide film or the like, thereonto so as to prevent the protection insulating film which is the electrode protection film from being degraded.

Figure 26B:
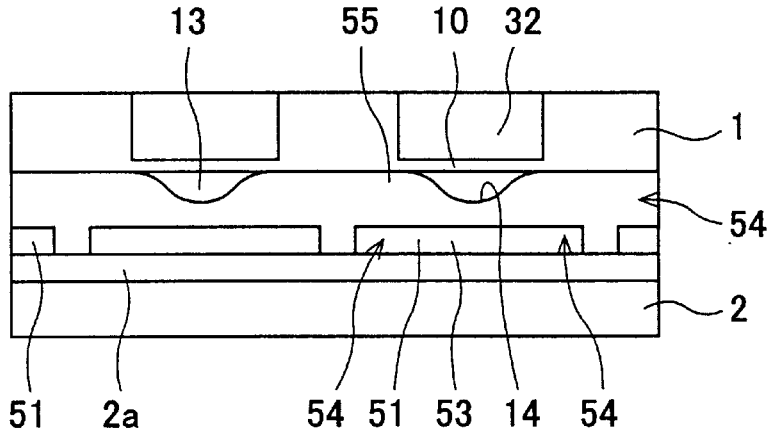

Then, as shown in FIG. 26B, recesses 32 are formed into the silicon base body 31 for a flow-path pattern for the liquid chambers 7 and so forth, the liquid chambers 7, vibration plates 10 and so forth are formed, and, thus, the vibration-plate substrate 1 is obtained. In this case, a silicon substrate having a crystal plane orientation (110) is used as the silicon base body 31, and, anisotropic etching is performed with KOH solution on the order of 10 wt % through 30 wt %. A mask used in the anisotropic etching is formed as a result of patterning a nitride film formed by reduced pressure CVD or plasma CVD, or a laminated film made of an oxide film and the above-mentioned nitride film.

Figure 26C:
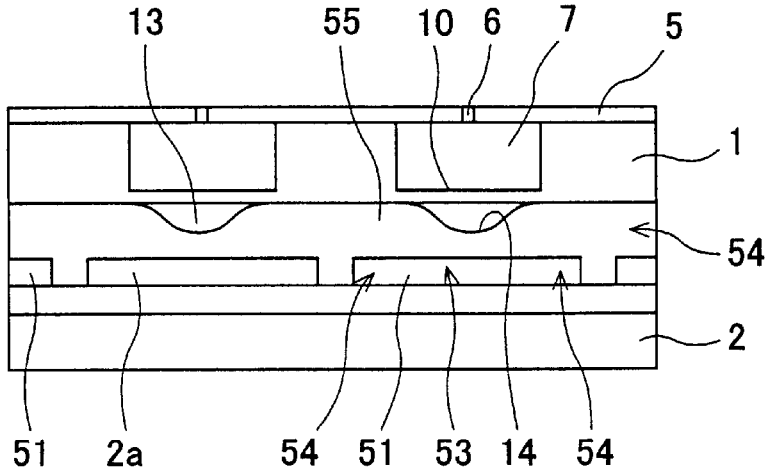

Then, as shown in FIG. 26C, the nozzle plate 5 is bonded onto the vibration-plate substrate 1, and, thus, the ink-jet head is obtained.

As mentioned above, in the above-described method, as the gap spacer parts 54 and electrode parts 53 becoming the electrodes are formed from the same layer configuration, the gap shape and depth can be controlled well and the gaps can be formed uniformly. Thereby, it is possible to easily form the zero gap non-parallel shapes by which the smooth contact is rendered. Further, as the parts of the electrode part 53 is used as the gap spacer parts 54, it is possible to perform gap control at a high accuracy. Furthermore, as the electrode parts 53 are embedded by the protection insulating film such as an oxide film, polishing process and/or formation of gradation pattern can be easily performed after separation of the electrodes. The other advantages/effects obtained from the above-described second and third embodiments are also obtained from this fourth embodiment.

Figure 27:
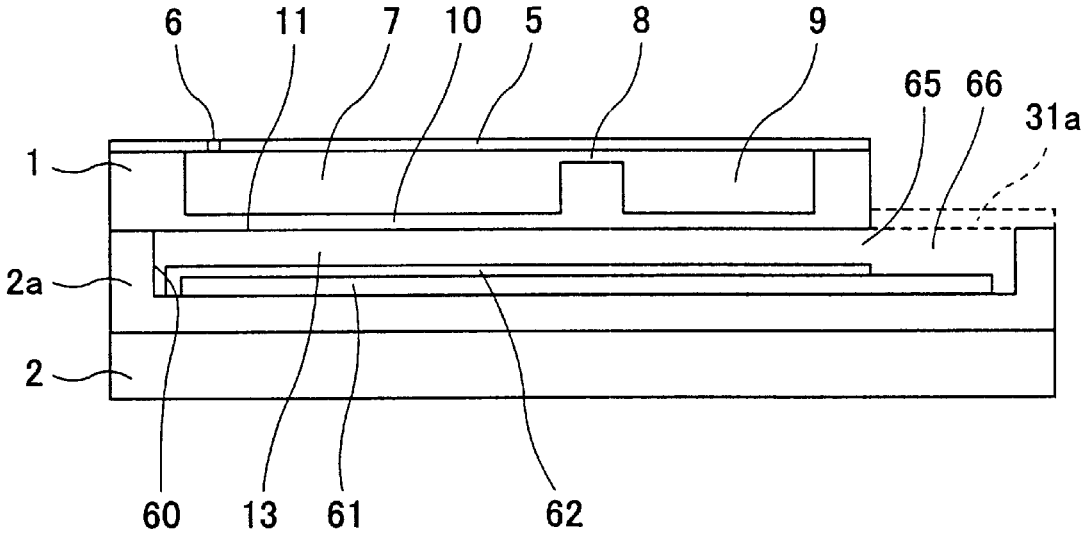
FIG. 27 shows a typical sectional view of a comparison example to each of the above-mentioned embodiments taken along a vibration-plate longitudinal direction.
Figure 28:
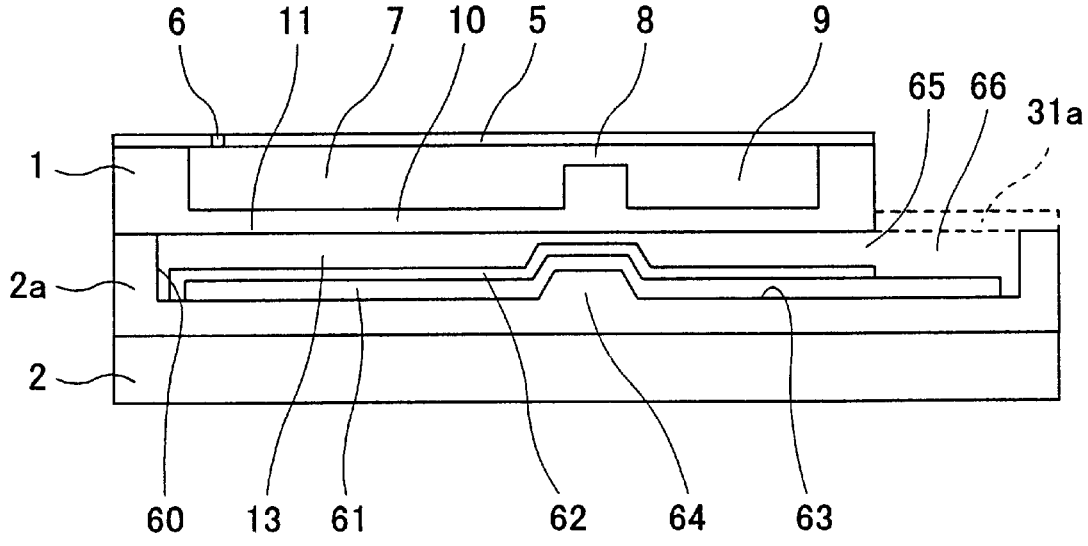
FIG. 28 shows a typical sectional view of another comparison example to each of the above-mentioned embodiments taken along a vibration-plate longitudinal direction.

With regard to difference between a case where, as in each of the above-described embodiments, the electrode (electrode layer including the protection film) and gap spacer part are made of the same layer configuration and a case where they are not made of the same layer configuration, description will now be made with reference FIGS. 27 and 28 illustrating examples where they are not made of the same layer configuration.

In each of the examples shown in FIGS. 27 and 28, a groove 60 for forming an electrode is formed into an oxide film 2*a* of a base substrate 2, the electrode 61 is formed on a bottom surface of this groove 60, and a protection insulating film 62 is formed on the electrode 61. As a gap spacer part, a part of the oxide film 2*a* other than the groove 60 is used. In the example shown in FIG. 28, a projection 64 is formed between the groove 60 and another groove 63 for drawing the electrode, while, in FIG. 27, the groove 60 is also used as a groove for drawing the electrode.

As can be seen from FIGS. 27 and 28, in the case where the electrode layer is not made of the same layer configuration as that of the gap spacer part, a gap 13 is opened externally through the groove 60 for forming the electrode or the groove 63 for drawing the electrode, and, it is difficult to completely seal the gap 13. Thereby, when a group of head chips formed on a wafer are divided into particular chips by dicing using water, the water may enter the electrostatic gaps 13 from openings 65.

In order to prevent this problem, as shown by broken lines in the figures, the dicing is performed while a part 31*a* of the silicon substrate 31 on the side of the vibration plate 1 is left, and, then, the part 31*a* is removed so that an opening 66 for drawing the electrode therethrough can be formed (electrode pad part is formed). In this case, a process of formation of the opening 66 for drawing the electrode is needed for each chip, and, thus, advantages in the wafer process is reduced. Further, when formation of the opening 66 for drawing the electrode is performed before the wafer is diced into particular chips, it is necessary to previously seal the opening 65 before the dicing (however, the opening 66 for drawing the electrode should not be sealed), and this may occur considerably difficult problems in consideration of thermal hysteresis in the subsequent process or the like.

In contrast thereto, as in each of the above-described embodiments of the present invention, when the electrode (electrode layer including the protection film) is made of the same layer configuration as that of the gap spacer part, it is possible to completely seal the periphery of the gap 13. Thereby, water is prevented from entering the gap 13 when the dicing is performed for separating into particular head chips, the process is simplified, and, thus, inexpensive heads can be obtained.

Figure 29:
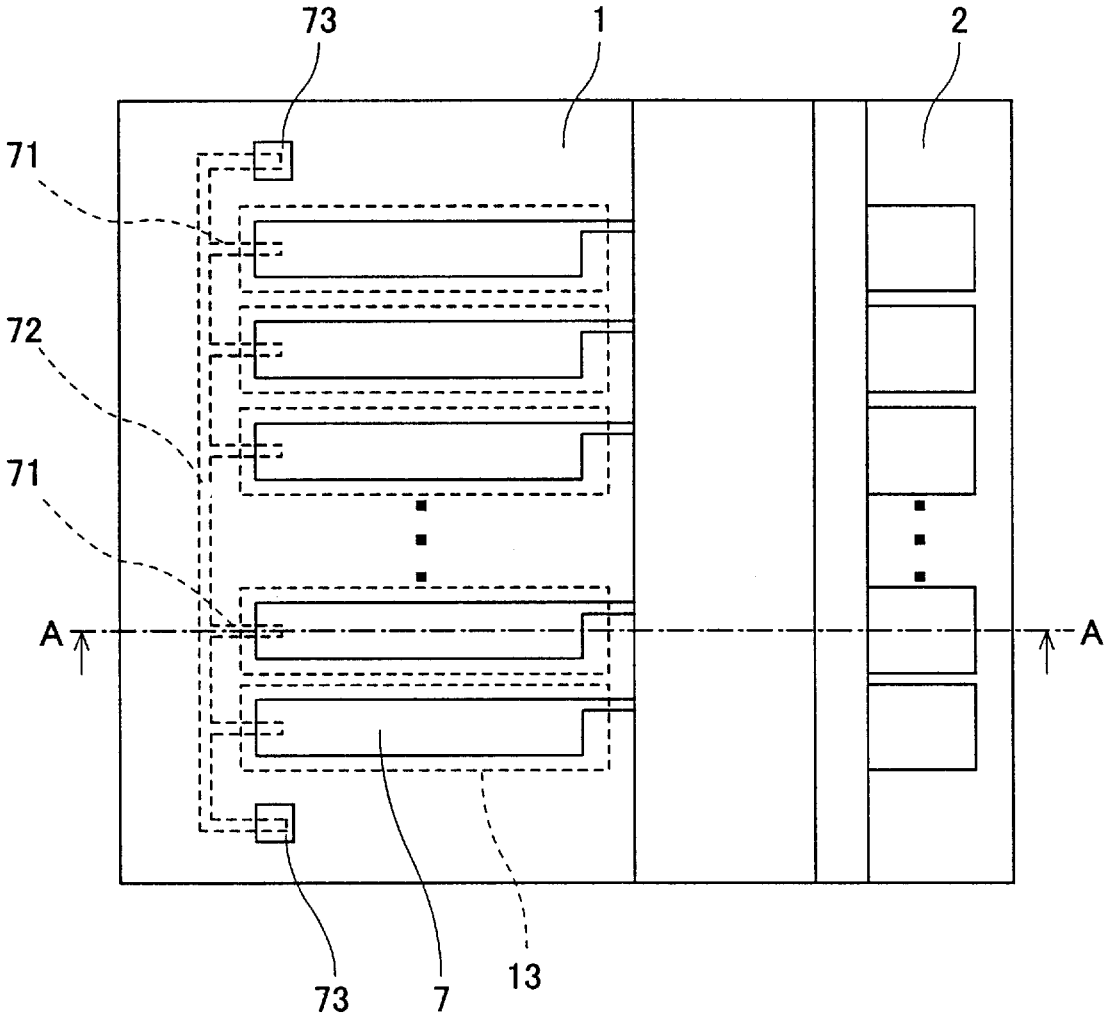
FIG. 29 shows a plan view of an ink-jet head in a fifth embodiment of the present invention.
Figure 30:
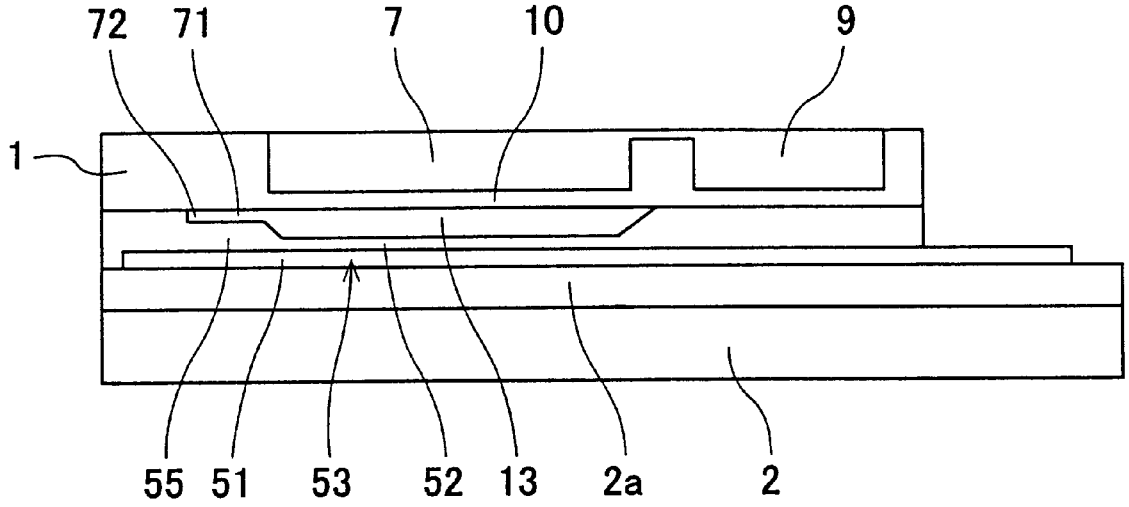
FIG. 30 shows a sectional view of the same head taken along a line A—A of FIG. 29.

With reference to FIGS. 29 and 30, a fifth embodiment of the present invention will now be described. FIG. 29 shows a plan view of an ink-jet head in the fifth embodiment in which a nozzle plate is omitted from being shown, and FIG. 30 shows a side-elevational sectional view of the same ink-jet head taken along a line A—A of FIG. 29.

In this embodiment, a communication path 71 communicating with each gap 13 and a common communication path 72 communicating among the respective communication paths 71 are formed in an oxide film 52 (or a high-temperature oxide film 55), and, an atmosphere opening hole 73 is formed at an end of the common communication path 72.

These communication paths 71, common communication path 72 and atmosphere opening hole 73 are provided without colliding or overlapping with electrode drawing parts (electrode taking-out parts) or dicing lines. Accordingly, no water entrance occurs in the dicing process or the like. Furthermore, the atmosphere opening hole 73 is formed through a process similar to that for forming the vibration plate 10 (with a thickness similar to that of the vibration plate 10 left), and, a process of boring thereinto performed by prick, laser beam or the like in required timing.

The inside of the gap 13 is in a positive/negative pressure in general because it is sealed. When direct bonding of silicon substrate is performed in each the above-described embodiments in a vacuum pressure (or reduced pressure), for example, the inside of the gap 13 may be maintained in a vacuum pressure. In this case, when the vibration plate is remarkably deformed due such a vacuum or reduced pressure before an electric field is applied between the vibration plate and particular electrode, the efficiency of the head is degraded, and, also, various variations in performance (variation in required driving voltage, variations in firing ink amount, firing ink velocity, position at which fired ink arrived, and so forth) may occur. In order to prevent such problematic situations, it is preferable to previously open the gap 13 to the atmospheric pressure in the atmosphere, nitrogen gas atmosphere, inert gas atmosphere, or the like. For this purpose, in the fifth embodiment of the present invention, the communication paths 71, 72 and opening 73 are provided for opening the gap 13 to the atmospheric pressure.

In this embodiment, if filling with the insulating film 55 the electrode separating part 56 and also above it in the fourth embodiment (see FIGS. 23, 25A–25D, 26A–26C) is not satisfactory, and, thereby, a chink develops (for example, a shallow like an opening exists in the insulating film on the separating part 56, a recess exists in the surface of the oxide film 55 on the separating part 56 due to unsatisfactory polishing, or the like), water may enter the gap from this chink through the above-mentioned communication paths 71 and 72 at a time of the dicing process, or washing process. Accordingly, in order to completely render both the opening the gap 13 to the atmospheric pressure and preventing water from entering the gap, it is preferable to completely fill the separating part 56 and above it with a flat surface without such a chink.

Figure 31:
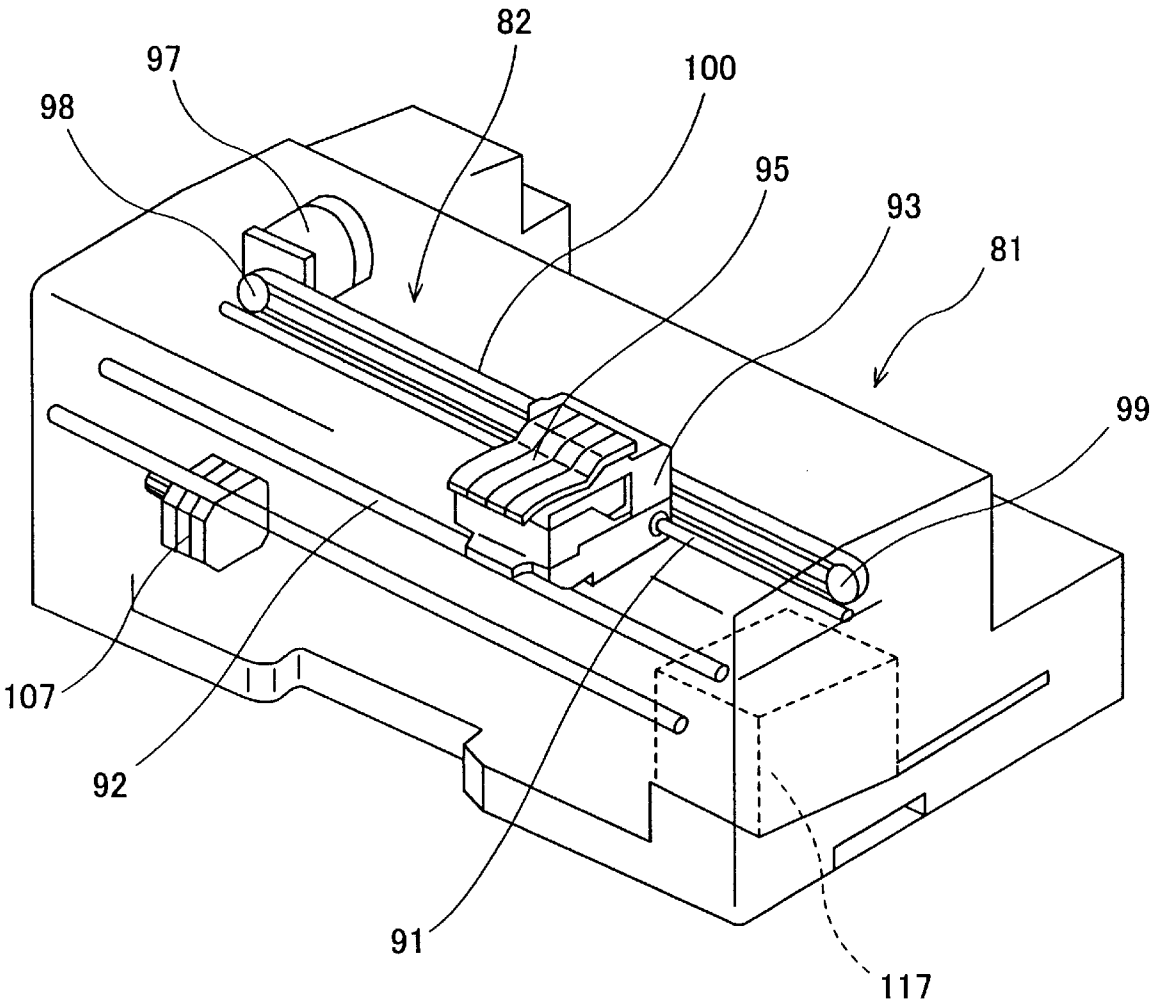
FIG. 31 shows a general internal perspective view of mechanical parts of an ink-jet recording device according to the present invention.
Figure 32:
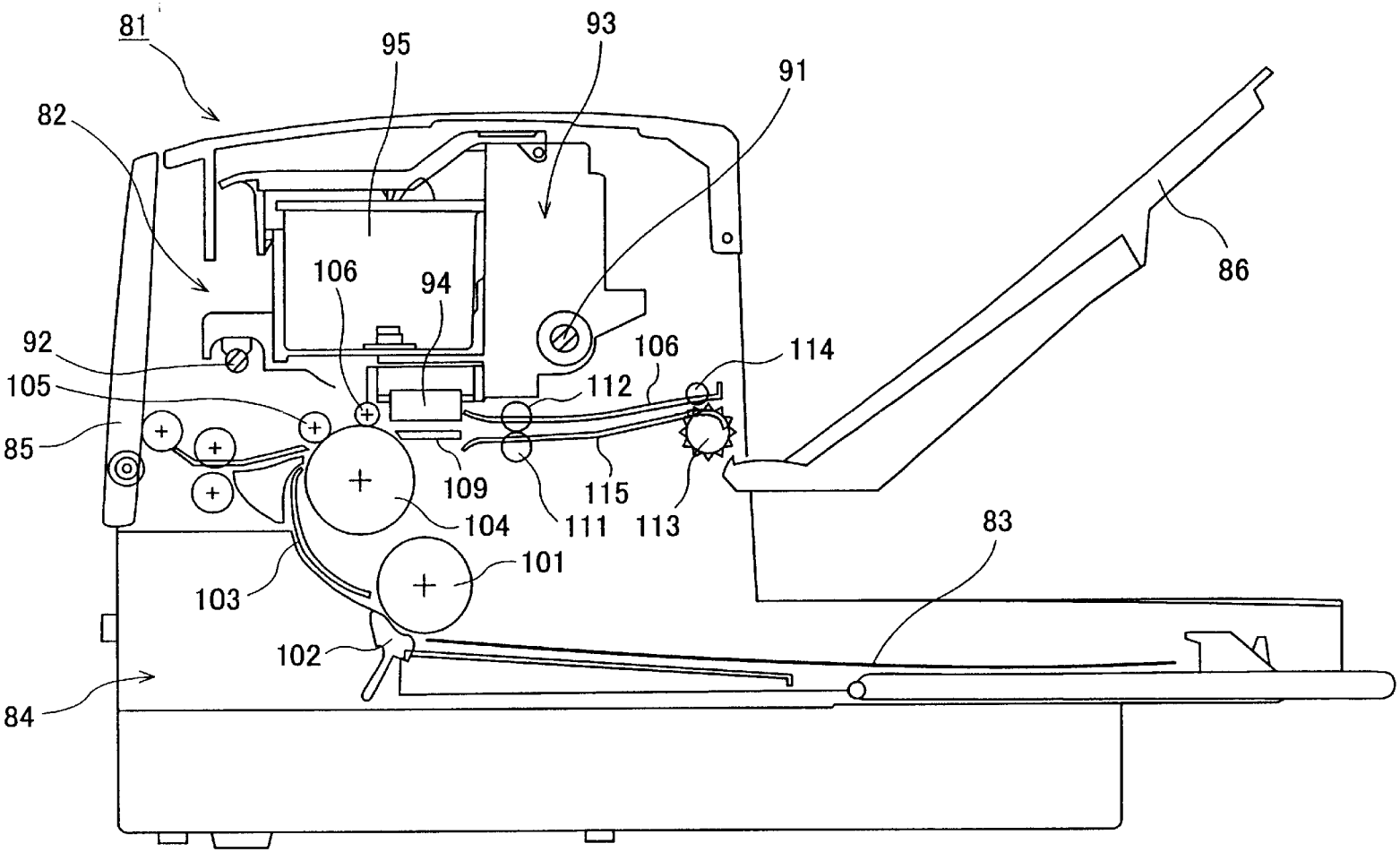
FIG. 32 shows a side-elevational sectional view of the mechanical parts of the same ink-jet recording device.

An ink-jet recording device according to the present invention will now be described with reference to FIGS. 31 and 32. FIG. 31 shows a general perspective view of an internal mechanical configuration of the recording apparatus while FIG. 32 shows a side elevational sectional view of the same device.

This recording device includes, inside of a recording device body 81, a printing mechanism part 82 including a carriage which can move in a main scanning direction, a recording head including ink-jet heads (liquid-firing heads) according to the present invention mounted on the carriage, ink cartridges and so forth. A paper feeding cassette 84 (or a paper feeding tray) is detachably loaded into a bottom part of the device body 81, in which many sheets of paper 83 are loaded from the front. Further, it is possible to open a hand paper feeding tray 85 for feeding paper 83 manually. Then, the paper 83 fed from the paper feeding cassette 84 or hand paper feeding tray 85 is taken by a mechanism, recording of a desired image is rendered thereonto by the printing mechanism part 82, and, then, the paper is ejected to a paper ejecting tray 86.

In the printing mechanism 82, the carriage 83 is held, slidably in the main scanning direction, by a main guiding rod 91 and a sub-guiding rod 92 provided laterally between side plates of the device, not shown in the figures. In the carriage 93, the head 94 is loaded including the liquid-firing heads (ink-jet heads) according to the present invention for firing ink drops of respective colors, i.e., yellow (Y), cyan (C), magenta (M), black (Bk) in a manner such that the direction in which the ink drop is fired is directed downward. Above the carriage 93, ink tanks (ink cartridges) 95 are exchangeably loaded for supplying the ink of the respective colors. The ink is supplied into the head 94 through the above-mentioned ink supply holes 18 from these ink cartridges 95.

The positions of the above-mentioned ink supply holes 18 are not limited to the ink firing surface (nozzle plate 5 loading surface), and, it is also possible to provide them in the opposite surface (reverse side surface; the surface of the base substrate), side surfaces, or the like.

A rear end (downstream end in a paper feeding direction) of the carriage 93 has the main guiding rod 91 slideably fitted therethrough while a front end thereof (upstream end in the paper feeding direction) is slidably placed on the sub-guiding rod 92. Then, in order to move the carriage 93 to render a scanning operation in the main scanning direction, a timing belt 100 is stretched between a driving pulley 98, driven so as to be rotated by a main scanning motor 97, and a following pulley 99, and the timing belt 100 is fixed to the carriage 93. Further, although the head 94 (recording head) includes head units for the respective colors in this configuration, it is also possible that the head 94 includes only a single head unit having nozzles for firing inks of the respective colors.

In order to convey the paper 83 set in the paper feeding cassette 84 to a position below the head 94, a paper feeding roller 101 and a friction pad 102 for taking each paper sheet 83 from the cassette 84 and feeding it, a guiding member 103 for guiding the paper 83, a conveying roller 104 for inverting the fed paper 83 and conveying it, a conveying sub-roller 105 pressed onto the circumferential surface of the conveying roller 104 and an edge roller 106 defining a sending-out angle of the paper 83 are provided. The conveying roller 104 is driven so as to be rotated by a sub-scanning motor 107 via a gear series.

Further, a printing holder member 109 is provided for guiding, below the recording head 94, the paper 83 fed by the conveying roller 104 in a position corresponding to a range of movement of the carriage 93 in the main scanning direction. Conveying rollers 111, 112 driven so as to roll for ejecting the paper 83 are provided in the downstream direction of the printing holder member 109. Furthermore, ejecting rollers 113, 114 for further ejecting the paper 83 to the paper ejecting tray 86, and guiding members 115, 116 guiding the ejected paper 83 are disposed.

Further, a reliability maintaining and recovering mechanism 117 for maintaining and recovering the reliability of the head 94 is disposed on the right side in the direction of movement of the carriage 93. The carriage 93 is moved to this mechanism 117 while printing operation is not performed where the head 94 is capped by a capping unit or the like.

In each of the above-described embodiments, a liquid-firing head according to the present invention is applied to an electrostatic ink-jet head. However, embodiments of the present invention are not limited thereto, and, the present invention can be applied to a liquid-firing head which fires a liquid other than ink, for example, a liquid resist-for patterning, or the like. Further, a micro-actuator (comprising the electrode and vibration plate of the liquid-firing head in each of the above-mentioned embodiments) according to the present invention can also be applied to an actuator part of a micro-motor, for example.

Further, although the liquid-firing heads in the embodiments in a type in which the direction in which the vibration plate is deformed is the same as the direction in which the ink drop is fired were described, the present invention can also be applied to a liquid-firing head of a side shooter type in which the direction in which the vibration plate is deformed is perpendicular to the direction in which the ink drop is fired.

The present invention is not limited to the above-described embodiments, and variations and modifications may be made without departing from the scope of the present invention.

The present application is based on Japanese priority application No. 2000-185712, filed on Jun. 21, 2000, the entire contents of which are hereby incorporated by reference.

What is claimed is:

1. A liquid-firing head comprising:

a nozzle firing a liquid drop;

a liquid chamber communicating with said nozzle;

a vibration plate which acts as a wall of said liquid chamber; and an electrode facing said vibration plate, and wherein said vibration plate is deformed by an electrostatic force, and, thereby, the liquid drop is fired through said nozzle, and wherein a groove for forming a gap between said electrode and said vibration plate is formed in said electrode.

2. The liquid-firing head as claimed in claim 1, wherein said electrode comprises a polysilicon layer.

3. The liquid-firing head as claimed in claim 1, wherein said gap formed by said groove of said electrode has an inclined surface providing a part at which a gap length is zero.

4. The liquid-firing head as claimed in claim 1, wherein the surface of said gap spacer part is mirror-polished so as to have a surface morphology not larger than 1 nm.

5. The liquid-firing head as claimed in claim 1, wherein the periphery of said gap is sealed.

6. The liquid-firing head as claimed in claim 5, wherein a measure enabling the inner pressure of said gap to be opened to the atmospheric pressure during manufacture thereof is provided.

7. The liquid-firing head as claimed in claim 6, wherein a communicating path enabling said gap to communicate with the atmosphere is provided in a region other than an electrode drawing part for externally drawing the electrode.

8. A method of manufacturing the liquid-firing head claimed in claim 6, comprising the step of opening the inner pressure of said gap to the atmospheric pressure during manufacture thereof through a communicating path provided in a region other than an electrode drawing part for externally drawing the electrode.

9. An ink-jet recording device comprising an ink-jet head for firing an ink drop, wherein said ink-jet head is formed by the method claimed in claim 8.

10. A method of manufacturing the liquid-firing head claimed in claim 5, comprising the step of opening the inner pressure of said gap to the atmospheric pressure during manufacture thereof.

11. An ink-jet recording device comprising an ink-jet head for firing an ink drop, wherein said ink-jet head is formed by the method claimed in claim 10.

12. A method of manufacturing the liquid-firing head claimed in claim 1 comprising the steps of:

a) polishing the surface of said electrode; and b) forming said groove said step a).

13. An ink-jet recording device comprising an ink-jet head for firing an ink drop, wherein said ink-jet head is formed by the method claimed in claim 12.

14. A method of manufacturing the liquid-firing head claimed in claim 1, comprising the steps of:

a) forming said groove in said electrode; and b) dividing said electrode to particular electrodes after said step a).

15. An ink-jet recording device comprising an ink-jet head for firing an ink drop, wherein said ink-jet head is formed by the method claimed in claim 14.

16. An ink-jet recording device comprising an ink-jet head for firing an ink drop, wherein said ink-jet head comprises the liquid-firing head claimed in claim 1.

17. A liquid-firing head comprising:

a nozzle firing a liquid drop;

a liquid chamber communicating with said nozzle;

a vibration plate which acts as a wall of said liquid chamber; and an electrode facing said vibration plate, and wherein said vibration plate is deformed by an electrostatic force, and, thereby, the liquid drop is fired through said nozzle, and wherein a groove for forming a gap between a protection insulating film, formed on said electrode, and said vibration plate is formed in said protection insulating film.

18. The liquid-firing head as claimed in claim 17, wherein said electrode comprises one of a polysilicon layer, a tungsten silicide layer, a titan silicide layer, and a laminated layer thereof.

19. The liquid-firing head as claimed in claim 17, wherein said protection insulating film comprises one of a polysilicon oxide film or a high-temperature oxide film.

20. The liquid-firing head claimed in claim 17, wherein said protection insulating film fills a separating region between the electrodes.

21. The liquid-firing head as claimed in claim 20, wherein said groove is formed after said electrode is divided into particular electrodes, said protection insulating film fills a separating region between the particular electrodes, and the surface of said protection insulating film is polished.

22. A method of manufacturing the liquid-firing head claimed in claim 20, comprising the steps of:

a) dividing said electrode into particular electrodes;

b) filling a separating region between the particular electrodes with said protection insulating film;

c) polishing the surface of said protection insulating film; and d) forming said groove after said steps a), b) and c).

23. An ink-jet recording device comprising an ink-jet head for firing an ink drop, wherein said ink-jet head is formed by the method claimed in claim 22.

24. The liquid-firing head as claimed in claim 17, wherein said gap formed by said groove of said protection insulating film has an inclined surface providing a part at which a gap length is zero.

25. The liquid-firing head as claimed in claim 24, wherein said groove is formed after said electrode is divided into particular electrodes, said protection insulating film fills a separating region between the particular electrodes, and the surface of said protection insulating film is polished.

26. A method of manufacturing the liquid-firing head claimed in claim 24, comprising the steps of:

a) dividing said electrode into particular electrodes;

b) filling a separating region between the particular electrodes with said protection insulating film;

c) polishing the surface of said protection insulating film; and d) forming said groove after said steps a), b) and c).

27. The liquid-firing head as claimed in claim 17, wherein the surface of said gap spacer part is mirror-polished so as to have a surface morphology not larger than 1 nm.

28. An ink-jet recording device comprising an ink-jet head for firing an ink drop, wherein said ink-jet head is formed by the method claimed in claim 26.

29. The liquid-firing head as claimed in claim 17, wherein the periphery of said gap is sealed.

30. The liquid-firing head as claimed in claim 29, wherein a measure enabling the inner pressure of said gap to be opened to the atmospheric pressure during manufacture thereof is provided.

31. The liquid-firing head as claimed in claim 30, wherein a communicating path enabling said gap to communicate with the atmosphere is provided in a region other than an electrode drawing part for externally drawing the electrode.

32. A method of manufacturing the liquid-firing head claimed in claim 30, comprising the step of opening the inner pressure of said gap to the atmospheric pressure during manufacture thereof through a communicating path provided in a region other than an electrode drawing part for externally drawing the electrode.

33. An ink-jet recording device comprising an ink-jet head for firing an ink drop, wherein said ink-jet head is formed by the method claimed in claim 32.

34. A method of manufacturing the liquid-firing head claimed in claim 29, comprising the step of opening the inner pressure of said gap to the atmospheric pressure during manufacture thereof.

35. An ink-jet recording device comprising an ink-jet head for firing an ink drop, wherein said ink-jet head is formed by the method claimed in claim 34.

36. A method of manufacturing the liquid-firing head claimed in claim 17 comprising the steps of:

a) polishing the surface of said protection insulating film; and b) forming said groove after said step a).

37. An ink-jet recording device comprising an ink-jet head for firing an ink drop, wherein said ink-jet head is formed by the method claimed in claim 36.

38. A method of manufacturing the liquid-firing head claimed in claim 17, comprising the steps of:

a) forming said groove in said protection insulating film; and b) dividing said electrode and said protection insulating film to particular electrodes and protection insulating films after said step a).

39. An ink-jet recording device comprising an ink-jet head for firing an ink drop, wherein said ink-jet head is formed by the method claimed in claim 38.

40. An ink-jet recording device comprising an ink-jet head for firing an ink drop, wherein said ink-jet head comprises the liquid-firing head claimed in claim 17.

41. A liquid-firing head comprising:

a nozzle firing a liquid drop;

a liquid chamber communicating with said nozzle;

a vibration plate which acts as a wall of said liquid chamber; and an electrode facing said vibration plate, and wherein said vibration plate is deformed by an electrostatic force, and, thereby, the liquid drop is fired through said nozzle, and wherein:

a gap spacer part determining a gap between said vibration plate and said electrode comprises the same layer as that of said electrode; and a groove for forming said gap between said electrode and said vibration plate is formed in said electrode.

42. The liquid-firing head as claimed in claim 41, wherein said electrode comprises a polysilicon layer.

43. The liquid-firing head as claimed in claim 41, wherein said gap formed by said groove of said electrode has an inclined surface providing a part at which a gap length is zero.

44. The liquid-firing head as claimed in claim 41, wherein the surface of said gap spacer part is mirror-polished so as to have a surface morphology not larger than 1 nm.

45. The liquid-firing head as claimed in claim 41, wherein the periphery of said gap is sealed.

46. The liquid-firing head as claimed in claim 45, wherein a measure enabling the inner pressure of said gap to be opened to the atmospheric pressure during manufacture thereof is provided.

47. The liquid-firing head as claimed in claim 46, wherein a communicating path enabling said gap to communicate with the atmosphere is provided in a region other than an electrode drawing part for externally drawing the electrode.

48. A method of manufacturing the liquid-firing head claimed in claim 46, comprising the step of opening the inner pressure of said gap to the atmospheric pressure during manufacture thereof through a communicating path provided in a region other than an electrode drawing part for externally drawing the electrode.

49. An ink-jet recording device comprising an ink-jet head for firing an ink drop, wherein said ink-jet head is formed by the method claimed in claim 48.

50. A method of manufacturing the liquid-firing head claimed in claim 45, comprising the step of opening the inner pressure of said gap to the atmospheric pressure during manufacture thereof.

51. An ink-jet recording device comprising an ink-jet head for firing an ink drop, wherein said ink-jet head is formed by the method claimed in claim 50.

52. A method of manufacturing the liquid-firing head claimed in claim 41 comprising the steps of:

a) polishing the surface of said electrode; and b) forming said groove after said step a).

53. An ink-jet recording device comprising an ink-jet head for firing an ink drop, wherein said ink-jet head is formed by the method claimed in claim 52.

54. A method of manufacturing the liquid-firing head claimed in claim 41, comprising the steps of:

a) forming said groove in said electrode; and b) dividing said electrode to particular electrodes after said step a).

55. An ink-jet recording device comprising an ink-jet head for firing an ink drop, wherein said ink-jet head is formed by the method claimed in claim 54.

56. An ink-jet recording device comprising an ink-jet head for firing an ink drop, wherein said ink-jet head comprises the liquid-firing head claimed in claim 41.

57. A liquid-firing head comprising:

a nozzle firing a liquid drop;

a liquid chamber communicating with said nozzle;

a vibration plate which acts as a wall of said liquid chamber; and an electrode facing said vibration plate, and wherein said vibration plate is deformed by an electrostatic force, and, thereby, the liquid drop is fired through said nozzle, and wherein:

a groove for forming a gap between said electrode and said vibration plate is formed in said electrode; and a part of said electrode is used as a gap spacer part determining said gap between said electrode and said vibration plate.

58. The liquid-firing head as claimed in claim 57, wherein said electrode comprises a polysilicon layer.

59. The liquid-firing head as claimed in claim 57, wherein said gap formed by said groove of said electrode has an inclined surface providing a part at which a gap length is zero.

60. The liquid-firing head as claimed in claim 57, wherein the surface of said gap spacer part is mirror-polished so as to have a surface morphology not larger than 1 nm.

61. The liquid-firing head as claimed in claim 57, wherein the periphery of said gap is sealed.

62. The liquid-firing head as claimed in claim 61, wherein a measure enabling the inner pressure of said gap to be opened to the atmospheric pressure during manufacture thereof is provided.

63. The liquid-firing head as claimed in claim 62, wherein a communicating path enabling said gap to communicate with the atmosphere is provided in a region other than an electrode drawing part for externally drawing the electrode.

64. A method of manufacturing the liquid-firing head claimed in claim 62, comprising the step of opening the inner pressure of said gap to the atmospheric pressure during manufacture thereof through a communicating path provided in a region other than an electrode drawing part for externally drawing the electrode.

65. An ink-jet recording device comprising an ink-jet head for firing an ink drop, wherein said ink-jet head is formed by the method claimed in claim 64.

66. A method of manufacturing the liquid-firing head claimed in claim 61, comprising the step of opening the inner pressure of said gap to the atmospheric pressure during manufacture thereof.

67. An ink-jet recording device comprising an ink-jet head for firing an ink drop, wherein said ink-jet head is formed by the method claimed in claim 66.

68. A method of manufacturing the liquid-firing head claimed in claim 57 comprising the steps of:

a) polishing the surface of said electrode; and b) forming said groove after said step a).

69. An ink-jet recording device comprising an ink-jet head for firing an ink drop, wherein said ink-jet head is formed by the method claimed in claim 68.

70. A method of manufacturing the liquid-firing head claimed in claim 57, comprising the steps of:

a) forming said groove in said electrode; and b) dividing said electrode to particular electrodes after said step a).

71. An ink-jet recording device comprising an ink-jet head for firing an ink drop, wherein said ink-jet head is formed by the method claimed in claim 70.

72. An ink-jet recording device comprising an ink-jet head for firing an ink drop, wherein said ink-jet head comprises the liquid-firing head claimed in claim 57.

73. A liquid-firing head comprising:

a nozzle firing a liquid drop;

a liquid chamber communicating with said nozzle;

a vibration plate which acts as a wall of said liquid chamber; and an electrode facing said vibration plate, and wherein said vibration plate is deformed by an electrostatic force, and, thereby, the liquid drop is fired through said nozzle, and wherein:

said electrode has a protection insulating film on a surface thereof;

a gap spacer part determining a gap between said vibration plate and said electrode is formed of the laminated film same as an electrode layer comprising said electrode and said protection insulating film formed thereon; and a groove for forming said gap is formed in said protection insulating film.

74. The liquid-firing head as claimed in claim 73, wherein said electrode comprises one of a polysilicon layer, a tungsten silicide layer, a titan silicide layer, and a laminated layer thereof.

75. The liquid-firing head as claimed in claim 73, wherein said protection insulating film comprises one of a polysilicon oxide film or a high-temperature oxide film.

76. The liquid-firing head as claimed in claim 73, wherein said protection insulating film is also formed on a side surface of said electrode.

77. The liquid-firing head claimed in claim 73, wherein said protection insulating film fills a separating region between the electrodes.

78. The liquid-firing head as claimed in claim 77, wherein said groove is formed after said electrode is divided into particular electrodes; said protection insulating film fills a separating region between the particular electrodes; and the surface of said protection insulating film is polished.

79. A method of manufacturing the liquid-firing head claimed in claim 77, comprising the steps of:

a) dividing said electrode into particular electrodes;

b) filling a separating region between the particular electrodes with said protection insulating film;

c) polishing the surface of said protection insulating film; and d) forming said groove after said steps a), b) and c).

80. An ink-jet recording device comprising an ink-jet head for firing an ink drop, wherein said ink-jet head is formed by the method claimed in claim 79.

81. The liquid-firing head as claimed in claim 73, wherein said gap formed by said groove of said protection insulating film has an inclined surface providing a part at which a gap length is zero.

82. The liquid-firing head as claimed in claim 81, wherein said groove is formed after said electrode is divided into particular electrodes; said protection insulating film fills a separating region between the particular electrodes; and the surface of said protection insulating film is polished.

83. A method of manufacturing the liquid-firing head claimed in claim 81, comprising the steps of:

a) dividing said electrode into particular electrodes;

b) filling a separating region between the particular electrodes with said protection insulating film;

c) polishing the surface of said protection insulating film; and d) forming said groove after said steps a), b) and c).

84. An ink-jet recording device comprising an ink-jet head for firing an ink drop, wherein said ink-jet head is formed by the method claimed in claim 83.

85. The liquid-firing head as claimed in claim 73, wherein the surface of said gap spacer part is mirror-polished so as to have a surface morphology not larger than 1 nm.

86. The liquid-firing head as claimed in claim 73, wherein the periphery of said gap is sealed.

87. The liquid-firing head as claimed in claim 86, wherein a measure enabling the inner pressure of said gap to be opened to the atmospheric pressure during manufacture thereof is provided.

88. The liquid-firing head as claimed in claim 87, wherein a communicating path enabling said gap to communicate with the atmosphere is provided in a region other than an electrode drawing part for externally drawing the electrode.

89. A method of manufacturing the liquid-firing head claimed in claim 87, comprising the step of opening the inner pressure of said gap to the atmospheric pressure during manufacture thereof through a communicating path provided in a region other than an electrode drawing part for externally drawing the electrode.

90. An ink-jet recording device comprising an ink-jet head for firing an ink drop, wherein said ink-jet head is formed by the method claimed in claim 89.

91. A method of manufacturing the liquid-firing head claimed in claim 86, comprising the step of opening the inner pressure of said gap to the atmospheric pressure during manufacture thereof.

92. An ink-jet recording device comprising an ink-jet head for firing an ink drop, wherein said ink-jet head is formed by the method claimed in claim 91.

93. A method of manufacturing the liquid-firing head claimed in claim 73 comprising the steps of:

a) polishing the surface of said protection insulating film; and b) forming said groove after said step a).

94. An ink-jet recording device comprising an ink-jet head for firing an ink drop, wherein said ink-jet head is formed by the method claimed in claim 93.

95. A method of manufacturing the liquid-firing head claimed in claim 73, comprising the steps of:

a) forming said groove in said protection insulating film; and b) dividing said electrode and said protection insulating film to particular electrodes and protection insulating films after said step a).

96. An ink-jet recording device comprising an ink-jet head for firing an ink drop, wherein said ink-jet head is formed by the method claimed in claim 95.

97. An ink-jet recording device comprising an ink-jet head for firing an ink drop, wherein said ink-jet head comprises the liquid-firing head claimed in claim 73.

98. A liquid-firing head comprising:

a nozzle firing a liquid drop;

a liquid chamber communicating with said nozzle;

a vibration plate which acts as a wall of said liquid chamber; and an electrode facing said vibration plate, and wherein said vibration plate is deformed by an electrostatic force, and, thereby, the liquid drop is fired through said nozzle, and wherein:

said electrode has a protection insulating film on a surface thereof;

a groove for forming a gap between said vibration plate and said protection insulating film is formed in said protection insulating film; and a part of said electrode and said protection insulating film is used as a gap spacer part determining said gap between said vibration plate and said protection insulating film.

99. The liquid-firing head as claimed in claim 98, wherein said electrode comprises one of a polysilicon layer, a tungsten silicide layer, a titan silicide layer, and a laminated layer thereof.

100. The liquid-firing head as claimed in claim 98, wherein said protection insulating film comprises one of a polysilicon oxide film or a high-temperature oxide film.

101. The liquid-firing head as claimed in claim 98, wherein said protection insulating film is also formed on a side surface of said electrode.

102. The liquid-firing head claimed in claim 98, wherein said protection insulating film fills a separating region between the electrodes.

103. The liquid-firing head as claimed in claim 102, wherein said groove is formed after said electrode is divided into particular electrodes; said protection insulating film fills a separating region between the particular electrodes; and the surface of said protection insulating film is polished.

104. A method of manufacturing the liquid-firing head claimed in claim 102, comprising the steps of:

a) dividing said electrode into particular electrodes;

b) filling a separating region between the particular electrodes with said protection insulating film;

c) polishing the surface of said protection insulating film; and d) forming said groove after said steps a), b) and c).

105. An ink-jet recording device comprising an ink-jet head for firing an ink drop, wherein said ink-jet head is formed by the method claimed in claim 104.

106. The liquid-firing head as claimed in claim 98, wherein said gap formed by said groove of said protection insulating film has an inclined surface providing a part at which a gap length is zero.

107. The liquid-firing head as claimed in claim 106, wherein said groove is formed after said electrode is divided into particular electrodes; said protection insulating film fills a separating region between the particular electrodes; and the surface of said protection insulating film is polished.

108. A method of manufacturing the liquid-firing head claimed in claim 106, comprising the steps of:

a) dividing said electrode into particular electrodes;

b) filling a separating region between the particular electrodes with said protection insulating film;

c) polishing the surface of said protection insulating film; and d) forming said groove after said steps a), b) and c).

109. An ink-jet recording device comprising an ink-jet head for firing an ink drop, wherein said ink-jet head is formed by the method claimed in claim 108.

110. The liquid-firing head as claimed in claim 98, wherein the surface of said gap spacer part is mirror-polished so as to have a surface morphology not larger than 1 nm.

111. The liquid-firing head as claimed in claim 98, wherein the periphery of said gap is sealed.

112. The liquid-firing head as claimed in claim 111, wherein a measure enabling the inner pressure of said gap to be opened to the atmospheric pressure during manufacture thereof is provided.

113. The liquid-firing head as claimed in claim 112, wherein a communicating path enabling said gap to communicate with the atmosphere is provided in a region other than an electrode drawing part for externally drawing the electrode.

114. A method of manufacturing the liquid-firing head claimed in claim 112, comprising the step of opening the inner pressure of said gap to the atmospheric pressure during manufacture thereof through a communicating path provided in a region other than an electrode drawing part for externally drawing the electrode.

115. An ink-jet recording device comprising an ink-jet head for firing an ink drop, wherein said ink-jet head is formed by the method claimed in claim 114.

116. A method of manufacturing the liquid-firing head claimed in claim 111, comprising the step of opening the inner pressure of said gap to the atmospheric pressure during manufacture thereof.

117. An ink-jet recording device comprising an ink-jet head for firing an ink drop, wherein said ink-jet head is formed by the method claimed in claim 116.

118. A method of manufacturing the liquid-firing head claimed in claim 98 comprising the steps of:

a) polishing the surface of said protection insulating film; and b) forming said groove after said step a).

119. An ink-jet recording device comprising an ink-jet head for firing an ink drop, wherein said ink-jet head is formed by the method claimed in claim 118.

120. A method of manufacturing the liquid-firing head claimed in claim 98, comprising the steps of:

a) forming said groove in said protection insulating film; and b) dividing said electrode and said protection insulating film to particular electrodes and protection insulating films after said step a).

121. An ink-jet recording device comprising an ink-jet head for firing an ink drop, wherein said ink-jet head is formed by the method claimed in claim 120.

122. An ink-jet recording device comprising an ink-jet head for firing an ink drop, wherein said ink-jet head comprises the liquid-firing head claimed in claim 98.

123. A micro-actuator, comprising:

a vibration plate; and an electrode facing said vibration plate, wherein said vibration plate is displaced by an electrostatic force, and wherein one of said electrode and a protection insulating film formed on said electrode has a gap between said vibration plate and said electrode.

124. A micro-actuator, comprising:

a vibration plate; and an electrode facing said vibration plate, wherein said vibration plate is displaced by an electrostatic force, and wherein a gap spacer part determining a gap between said vibration and said electrode comprises the same layer as one of said electrode and said electrode with a protection insulating film.

* * * * *